United States Patent [19]

Kurematsu et al.

[11] Patent Number: 4,855,217

[45] **Date of Patent: * Aug. 8, 1989**

[54] PROCESSING OF COLOR PHOTOGRAPHIC MATERIAL UTILIZING A STABILIZING SOLUTION AFTER FIXING

[75] Inventors: Masayuki Kurematsu, Hino; Shigeharu Koboshi, Sagamihara, both of Japan

[73] Assignee: Konishiroku Photo Industry Co., Ltd., Tokyo, Japan

[ * ] Notice: The portion of the term of this patent subsequent to May 24, 2005 has been disclaimed.

[21] Appl. No.: 170,670

[22] Filed: Mar. 18, 1988

Related U.S. Application Data

[63] Continuation of Ser. No. 21,533, Feb. 26, 1987, abandoned, which is a continuation of Ser. No. 812,591, Dec. 23, 1985, abandoned.

[30] Foreign Application Priority Data

Dec. 26, 1984 [JP] Japan ..... 59-280964

[51] Int. Cl.[4] ..... G03C 7/40; G03C 5/24; G03C 11/00; G03C 7/26

[52] U.S. Cl. ..... 430/372; 430/428; 430/429; 430/432; 430/463; 430/551

[58] Field of Search ..... 430/372, 428, 429, 432, 430/463, 551

[56] References Cited

U.S. PATENT DOCUMENTS

| | | | |
|---|---|---|---|
| 3,647,460 | 3/1972 | Hofman et al. | 430/355 |
| 3,879,202 | 4/1975 | Yamaguchi | 96/60 |
| 4,440,852 | 4/1984 | Onishi et al. | 430/522 |
| 4,562,144 | 12/1985 | Kurematsu et al. | 430/372 |
| 4,746,598 | 5/1988 | Kurematsu et al. | 430/372 |
| 4,749,642 | 6/1988 | Kurematsu et al. | 430/372 |

*Primary Examiner*—Mukund J. Shah

*Attorney, Agent, or Firm*—Frishauf, Holtz, Goodman & Woodward

[57] ABSTRACT

A processing method for silver halide color photosensitive material in which said silver halide color photosensitive material is treated with a processing solution that has a fixing ability, and then is not washed, but treated with a washless stabilizer solution, characterized in that said silver halide color photosensitive material is treated with said washless stabilizer in the presence of at least one compound among compounds represented by General Formula [I], [II], [II'], or [II''] shown below; and that said washless stabilizer contains more than 20 mg/l silver ion, and at least one aldehyde compound.

General Formula [I]

General Formula [II]

General Formula [II']

General Formula [II'']

26 Claims, No Drawings

PROCESSING OF COLOR PHOTOGRAPHIC MATERIAL UTILIZING A STABILIZING SOLUTION AFTER FIXING

This application is a continuation of Ser. No. 21,533, filed Feb. 26, 1987, now abandoned, which is a continuation of U.S. Ser. No. 812,591 filed Dec. 23, 1985, now abandoned.

BACKGROUND OF THE INVENTION

The invention relates to a processing method of silver halide color photosensitive material (hereinafter referred to as photosensitive material), especially to a stabilizing method which substantially excludes any washing process subsequent to a desilvering process.

As the protection of environment and the preservation of water resources have recently been regarded as important, it has been desired that the amount of water should minimally be used in the washing process following the fixing or bleach-fixing process by photofinishers who have developed and processed photosensitive materials automatically and continuously. Accordingly, some techniques have been proposed to submit photosensitive materials to the stabilizing treatment immediately after the fixing or bleach-fixing process, skipping the washing process. For example, techniques to treat photosensitive materials with the stabilizer containing isothiazoline derivatives, benzoisothiazoline derivatives, soluble iron complex salts, polycarboxylic acids, or organic sulfonic acids have been described in Japanese Patent O.P.I. Publication Nos. 8542/1982, 132146/1982, 14834/1982 and 18631/1983.

These techniques relate to methods for inhibition or prevention of problems caused by intrusion of components of the fixer or bleach-fixer with the photosensitive material into the washless stabilizer. However, these techniques can not be applied practically against the excess of said intruded components over a certain level, but requires the supplement of a certain amount of the stabilizer correspondingly. There is a drawback of an increase of yellow stain of the unexposed area and a increase of fading of cyan dye during long-term preservation, particularly when there is an increase in the concentration of components of the fixer or bleach-fixer in the last bath for the washless stabilizer.

Some aldehyde compounds have previously been known as effective in preventing such a yellow stain. However, as described in examples in Japanese Patent O.P.I. Publication No. 134636/1983, these aldehydes have drawbacks to form a precipitate with silver ion or the like from the fixer within a short time, and to promote the fading of cyan dye during a long-term preservation, when they are used in the washless stabilizer, and, consequently, can not be put to practical use.

SUMMARY OF THE INVENTION

The first object of the invention is to prevent one of the above conventional drawbacks, the occurrence of precipitate in the washless stabilizer. The second object of the invention is to present a processing method of silver halide color photosensitive material, which makes it possible to largely reduce the amount of water for washing by preventing the fading of cyan dye during long-term preservation. The third object of the invention is to present a processing method of silver halide color photosensitive material, by which the effect of the prevention of increase in yellow stain of the unexposed area of the photosensitive material during long-term preservation is not reduced even though the washless stabilizer is stored for a long time.

As a result of elaborate studies, the inventors found that, in a processing method of photosensitive material in which said photosensitive material is treated with a processing solution that has a fixing ability, and then is not substantially washed, but treated with a washless stabilizer, the above objects of the invention are attained when said photosensitive material is treated with said washless stabilizer in the presence of at least one compound among compounds represented by General Formula [I], [II], [II'], or [II''] shown below each, and by that said washless stabilizer contains more than 20 mg/l silver ion and at least one aldehyde compound:

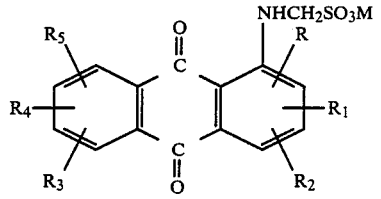

where each of R, $R_1$, $R_2$, $R_3$, $R_4$ and $R_5$ is a hydrogen or halogen atom, or a hydroxy, alkyl, alkoxy, sulfo or $—NHCH_2S_3H$; M is a cation.

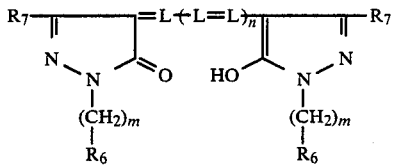

where each of $R_6$ and $R_6'$ is a hydrogen atom, or an alkyl, aryl or heterocyclic group (allowably substituted); each of $R_7$ and $R_7'$ is a hydroxy, alkoxy, substituted alkoxy, cyano, trifluoromethyl, $—COOR_8$, $—CONHR_8$, $—NHCOR_8$, amino, or $C_{1-4}$-alkyl-substituted amino group; or a cyclic amino group represented by a formula

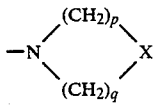

(where each of p and q is the integer 1 or 2; X is an oxygen or sulfur atom, or a $—CH_2$-group); $R_8$ is a hydrogen atom, or an alkyl or aryl group; L is a methin group; n is the integer 0, 1 or 2; each of m and m' is the integer 0 or 1.

General formula [II']

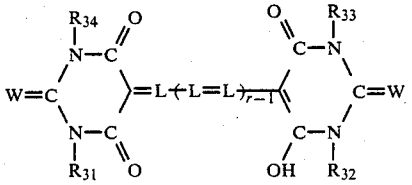

where r is the integer 1, 2 or 3; W is an oxygen or sulfur atom; L is a methin group; each of $R_{31}$ to $R_{34}$ is a hydrogen atom, an alkyl, aryl, or aralkyl group; at least one group of $R_{31}$ to $R_{34}$ is a substituent group other than a hydrogen atom; and L is a methin group.

General Formula [II'']

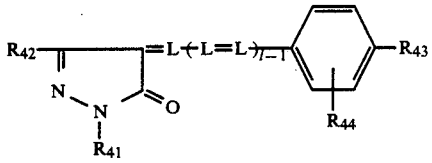

where l is the integer 1 or 2; L is a methin group; $R_{41}$ is an alkyl, aryl, or heterocyclic group; $R_{42}$ is a hydroxy, alkyl, alkoxy, substituted alkoxy, cyano, trifluoromethyl, —$COOR_8$, —$CONHR_8$, —$NHCOR_8$, amino, or $C_{1-4}$-alkyl-substituted amino group, or a cyclic amino group represented by a formula

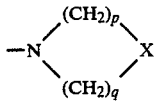

(where each of p and q is the integer of 1 or 2; X is an oxygen or sulfur atom, or a —$CH_2$— group); $R_8$ is a hydrogen atom, or an alkyl or aryl group; further, $R_{43}$ is allowed to be an —OZ, or

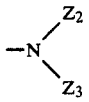

group where each of $Z_1$, $Z_2$ and $Z_3$ is a hydrogen atom, or an alkyl group; and $Z_2$ and $Z_3$ are allowed to be the same or to form a ring with the combination with each other; and $R_{44}$ is a hydrogen or chlorine atom, or an alkyl or alkoxy group.

Furthermore the inventors of the invention found that the above objects of the invention are attained further effectively by that said washless stabilizer contains at least $1\times10^{-3}$ mole sulfite in embodied modes of the invention, and, in addition, that the method of the invention is further effective against the above drawbacks which are exhibited when said processing solution that has a fixing ability contains thiosulfate.

DETAILED DESCRIPTION OF THE INVENTION

Further description of the invention is given as follows:

It has been known that, when the washing process which constitutes the last step of finishing photosensitive material is replaced with a washless stabilizing process, said stabilizing process is intruded by components of the fixer, and thereby causes particularly the promotion of yellow stain of the finished photosensitive material during preservation in the dark. Some of aldehyde compounds have been known as means to prevent such yellow stain, but have had serious drawbacks to form precipitate with silver ion, which formed complex salts with fixing agents and came together with the photosensitive material from the fixer, and to largely promote the fading of cyan dye during preservation of the finished photosensitive material in the dark.

As a result of elaborate studies, the inventors have found that compounds which were known as dyes used for photosensitive materials and were represented by General Formula [I], [II], [II'], or [II''] were effective to prevent the formation of said precipitate. It is a really surprising discovery that compounds represented by General Formula [I], [II], [II'], or [II''] among dyes used for photosensitive materials effectively act against said precipitate. The inventors have also found some sulfites effectively act against said precipitate in combined use with the above compounds. Silver ion then contained in the washless stabilizer in the invention is brought in by the photosensitive material from the fixer, and results in the above drawbacks when in an excess concentration over 20 mg/l. The method of the invention is effective to prevent such drawbacks.

The aldehydes to be contained by the washless stabilizer are aldehyde group-bearing compounds, and are substantially as follows, for example:

I-1 formaldehyde,
I-2 acetaldehyde,
I-3 propionaldehyde,
I-4 isobutylaldehyde,
I-5 n-butylaldehyde,
I-6 n-valeraldehyde,
I-7 isovaleraldehyde,
I-8 methyl-ethylacetaldehyde,
I-9 trimethylacetaldehyde,
I-10 n-hexaldehyde,
I-11 methyl-n-propylacetaldehyde,
I-12 isohexaldehyde,
I-13 glyoxal,
I-14 malonaldehyde,
I-15 succinaldehyde,
I-16 glutaraldehyde,
I-17 adipaldehyde,
I-18 methylglyoxal,
I-19 acetoacetic aldehyde,
I-20 glycolic aldehyde,
I-21 ethoxyacetamide,
I-22 aminoacetamide,
I-23 betaine aldehyde,
I-24 chloral,
I-25 chloroacetaldehyde,
I-26 dichloroacetaldehyde,
I-27 bromal,
I-28 dibromoacetaldehyde,
I-29 iodoacetaldehyde,
I-30 α-chloropropionacetaldehyde
I-31 α-bromopropionacetaldehyde, and
I-32 furfural.

The above aldehyde is desirably to be contained in the range of 0.1 to 50 g, preferably 0.5 to 10 g per liter of the washless stabilizer.

Detailed description of compounds which are used in the invention and represented by General Formula [I], [II], [II'], or [II''] is given below.

In General Formula [I]:

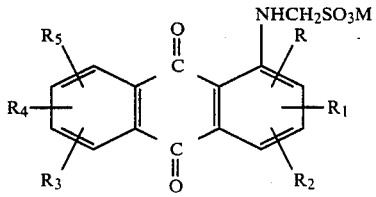

each of $R_1$, $R_2$, $R_3$, $R_4$ and $R_5$ is a hydrogen or halogen (for example, chlorine, bromine or fluorine) atom, or a hydroxy, $C_{1-4}$-alkyl (for example, methyl or propyl), alkoxy (for example, methoxy ethoxy or propoxy), $—SO_3M$, or $—NHCN_2SO_3M$ group. Therein M is a cation, for example, an alkali metal such as a sodium or potassium atom, ammonium salt or organic ammonium salt (for example, pyridinium, piperidinium, triethylammonium or triethanolamine).

Typical compounds represented by General Formula [I] are exemplified as follows, but compounds used in the invention are not limited to them.

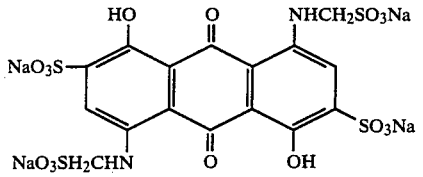
(A-1)

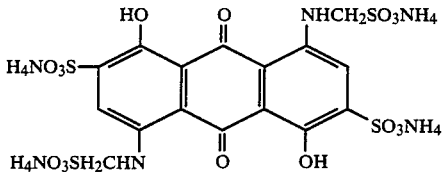
(A-2)

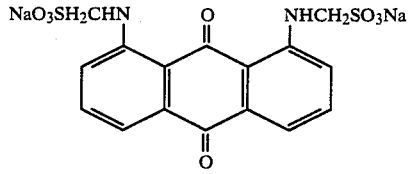
(A-3)

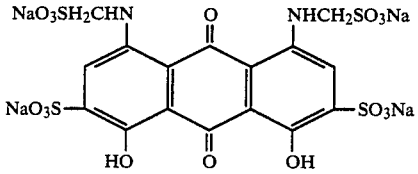
(A-4)

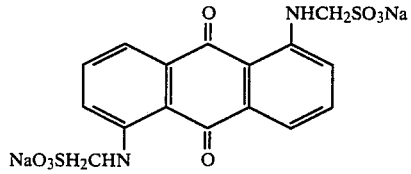
(A-5)

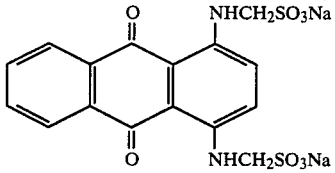
(A-6)

In General Formula [II]:

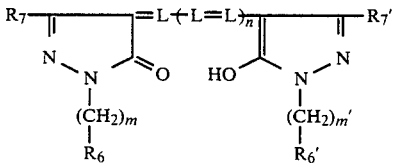

each of $R_6$ and $R_6'$ is a hydrogen atom, or an allowably substituted alkyl, aryl or heterocyclic group. Said aryl group is for example, a 4-sulfonyl, 4-(sulfomethyl) phenyl, 4-(δ-sulfobutyl) phenyl, 3-sulfophenyl, 2,5-disulfophenyl, 3,5-disulfopyenyl, 6,8-disulfo-2-naphtyyl, 4,8-disulfo-2-naphthyl, 3,5-dicarboxyphenyl, or 4-carboxyphenyl group; and said aryl group can have, for example, a sulfo, sulfoalkyl, carboxy, $C_{1-5}$-alkyl (for example, methyl or ethyl), a halogen (for example, chlorine or bromine) atom, $C_{1-4}$-alkoxy (for example, methoxy or ethoxy), or phenoxy group.

Said sulfo group is allowed to be combined through a divalent organic group with an aryl group, and hence to be, for example, a 4-(4-sulfophenoxy) phenyl, 4-(2-sulfoethyl) phenyl, 3-(sulfoethylamino) phenyl, or 4-(2-sulfoethoxy) phenyl group.

In General Formula [II], the alkyl group represented by $R_6$ is allowed to be linear, branched or cyclic, but preferably is composed of 1 to 4 carbon atoms, and hence an ethyl or β-sulfoethyl group, for example.

Said heterocyclic group is for example, a 2-(6-sulfo) benzothiazolyl, or 2-(6-sulfo) benzoxazolyl group, and is allowed to have a substituent such as a halogen (for example, fluorine, chlorine or bromine) atom, an alkyl (for example, methyl or ethyl), aryl (for example, phenyl), carboxyl, sulfo, hydroxy, alkoxy (for example, methoxy), or aryloxy (for example, phenoxy) group.

In General Formula [II], each of $R_7$ and $R_7'$ is a hydroxy, $C_{1-4}$-alkoxy (for example, methoxy, ethoxy, isopropoxy, or n-butoxy); substituted alkoxy (for example, halogen-substituted or $C_{1-2}$-alkoxy-substituted $C_{1-4}$alkoxy such as β-chloroethoxy or β-metnoxyethoxy); cyano; trifluoromethyl; $—COOR_8$; $—CONHR_8$; $—NHCOR_8$, [where said $R_8$ is a hydrogen atom, or a $C_{1-4}$-alkyl, or aryl (for example, phenyl or naphthyl) group, and said alkyl and/or aryl group has allowably a sulfo or carboxy group as a substituent]; amino; $C_{1-4}$-alkyl-substituted amino (for example, ethylamino, dimethylamino, diethylamino, d-n-butylamino); or cyclic (for example, morpholino, piperidino, or piperazino) group represented by

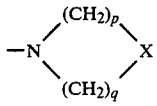

(where each of p and q is the integer 1 or 2; X is an oxygen or sulfur atom, or a $—CH_2—$ group).

The methine group represented by L is allowed to be substituted by a $C_{1-14}$-alkyl (for example, methyl, ethyl, isopropyl, or tert-butyl), or aryl (for example, phenyl or tolyl) group.

At least one group of the sulfo, sulfoalkyl and barboxy groups of the compound represented by General Formula [II] is allowed to form the salt with an alkali metal such as sodium and potassium; an alkali earth metal such as calcium and magnesium; ammonia; or an organic base such as diethylamine, trimethylamine, morpholine, pyridine and piperidine.

In General Formula [II], n is the integer 0, 1 or 2; each of m and m' is the integer 0 or 1.

Typical compounds represented by General Formula [II] are exemplified as follows, but compounds used in the invention are not limited to them.

(B-1)
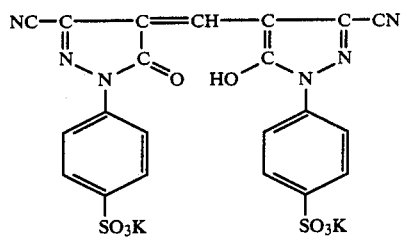
(B-2)
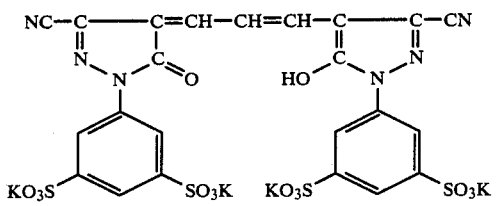
(B-3)
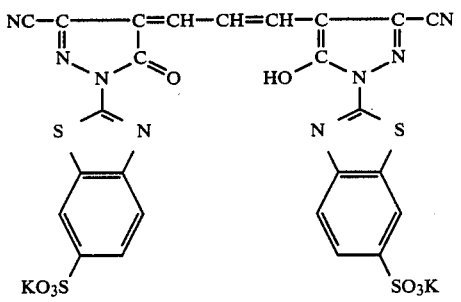
(B-4)
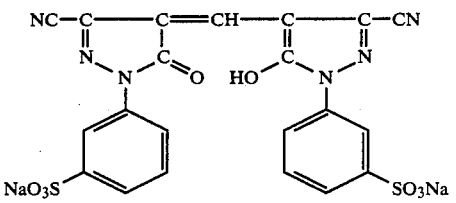
(B-5)
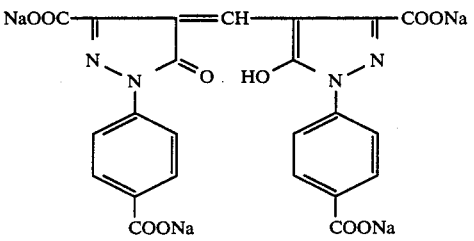
(B-6)
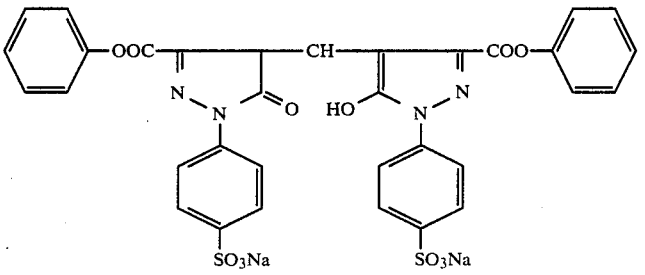

-continued
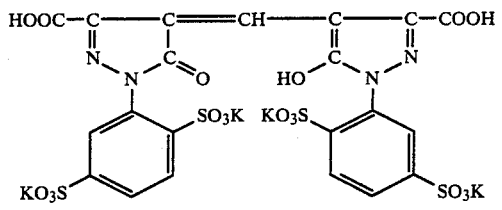
(B-7)
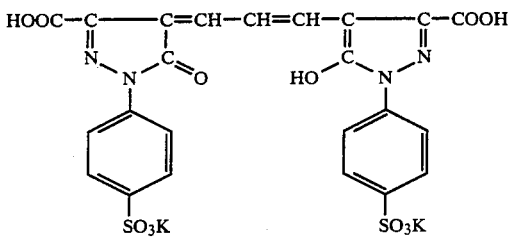
(B-8)
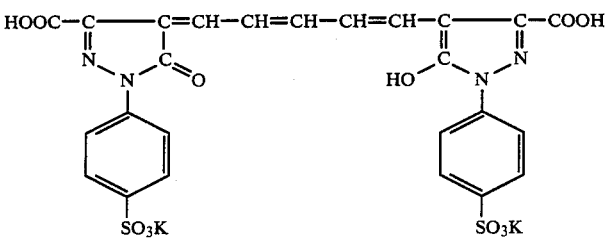
(B-9)
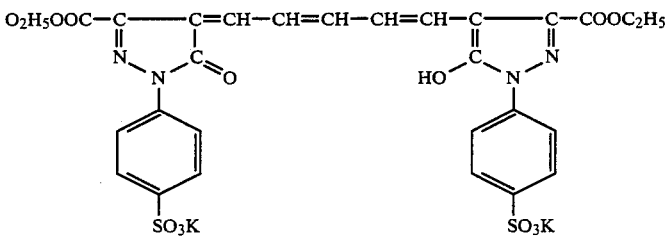
(B-10)
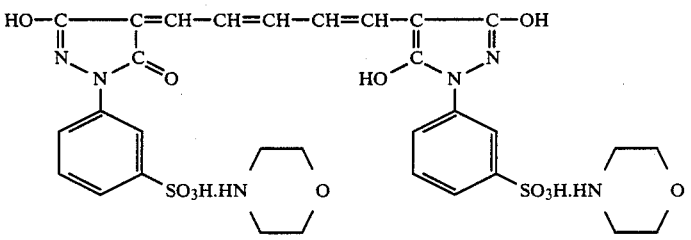
(B-11)
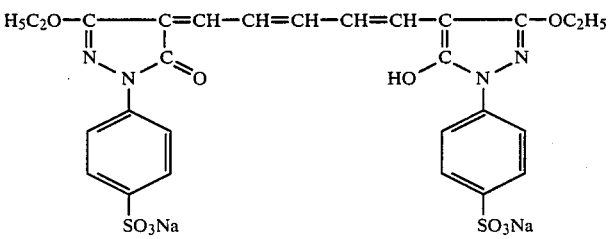
(B-12)

-continued
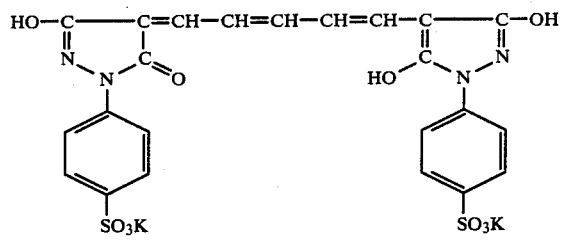
(B-13)
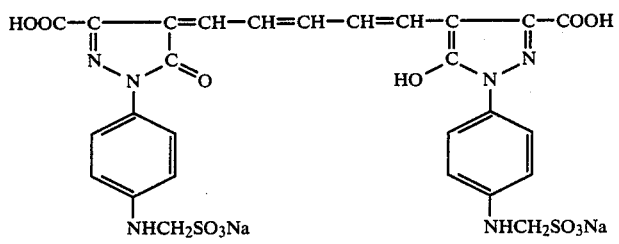
(B-14)
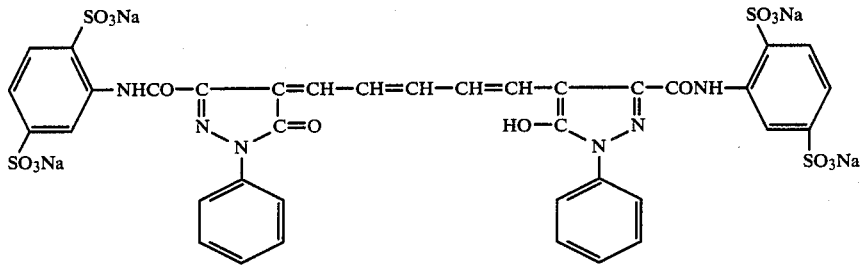
(B-15)
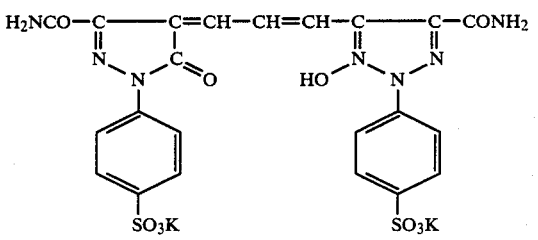
(B-16)
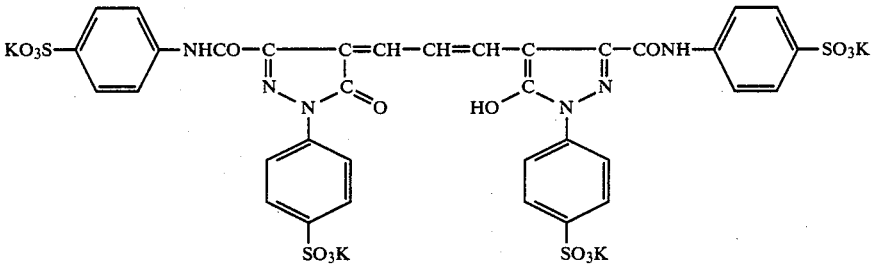
(B-17)
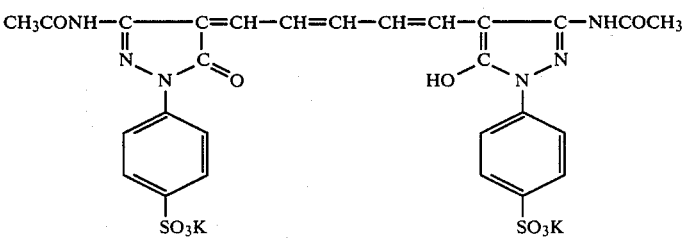
(B-18)

-continued
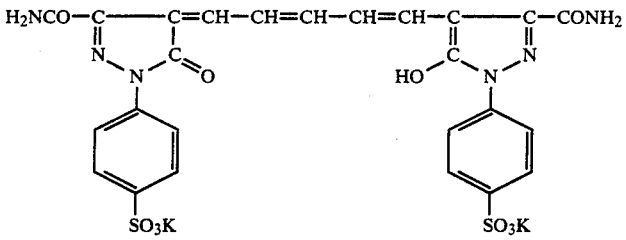
(B-19)
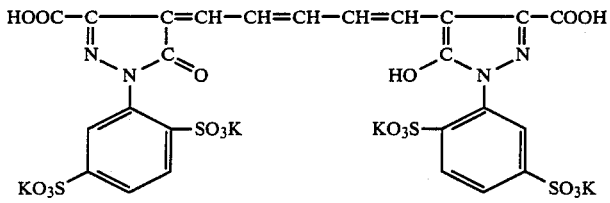
(B-20)
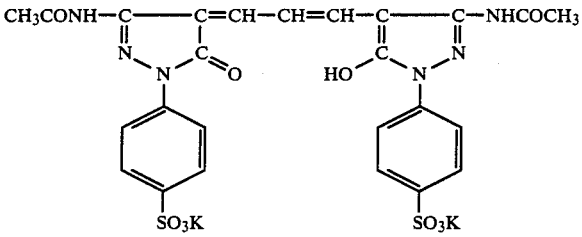
(B-21)
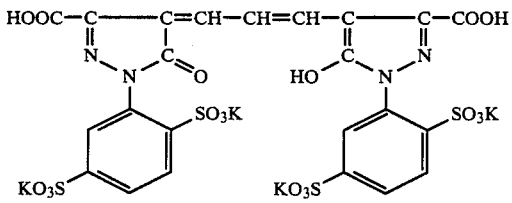
(B-22)
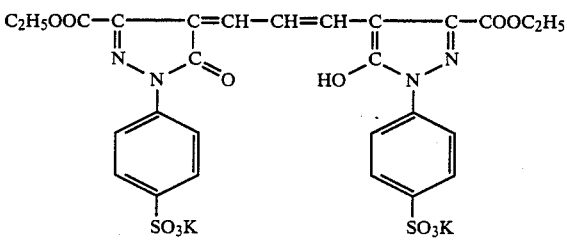
(B-23)
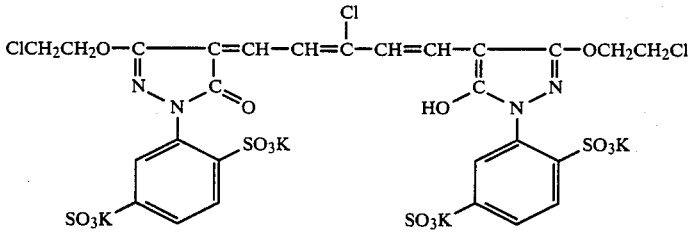
(B-24)
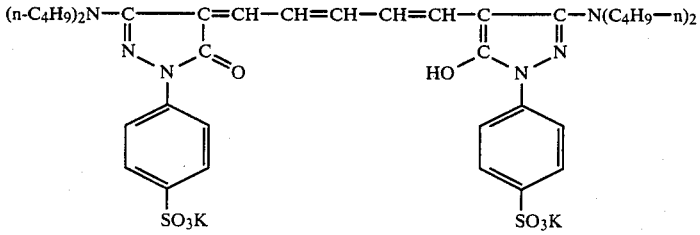
(B-25)

-continued

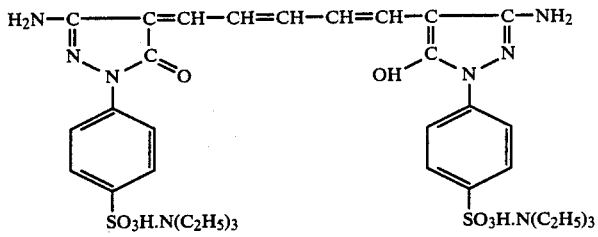

(B-26)

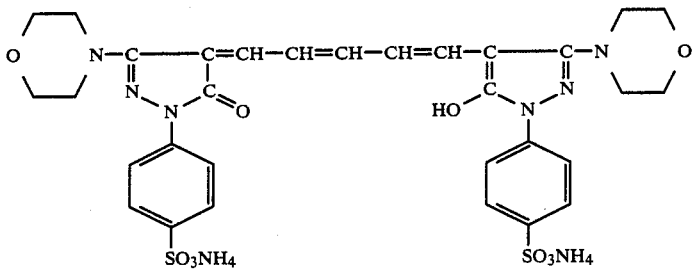

(B-27)

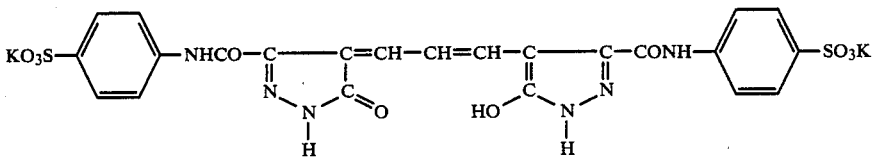

(B-28)

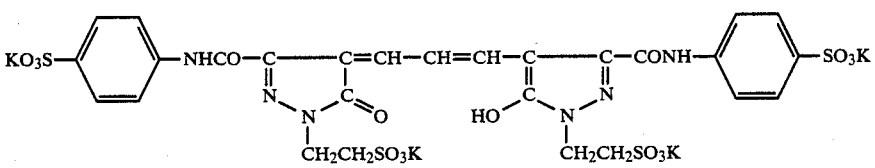

(B-29)

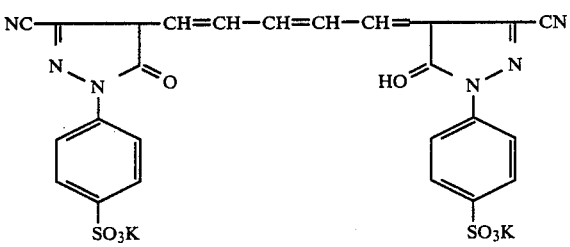

(B-30)

In General Formula [II']:

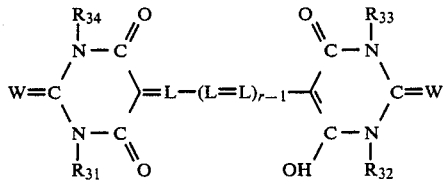

r is integer 1, 2 or 3; W is an oxygen or sulfur atom, L is a methin group; each of $R_{31}$ to $R_{34}$ is a hydrogen atom, or an alkyl, aryl aralkyl group; and at least one group of $R_{31}$ to $R_{34}$ is a substituent group other than a hydrogen atom.

The methine group represented by L in General Formula [II'] is allowed to be the same as that in General Formula [II].

The alkyl group represented by $R_{31}$, $R_{32}$, $R_{33}$ or $R_{34}$ in General Formula [II'] is allowed to be the same as that represented by $R_6$ or $R_6'$ in General Formula [II], and also to have the substituent group which is allowably the same as that for $R_6$ or $R_6'$ in General Formula [II], but preferably a sulfo, carboxy, hydroxy, alkoxy, alkoxycarbonyl, cyano, or sulfonyl group.

The aryl group represented by $R_{31}$, $R_{32}$, $R_{33}$ or $R_{34}$ in General Formula [II'] is preferably a phenyl group, and the substituent group which is introduced onto said phenyl group is allowed to the same as the substituent group that is introduced onto $R_6$ or $R_6'$ in General Formula [II], but preferably to be at least one group among sulfo, carboxy and sulfamoyl groups.

The aralkyl group represented by $R_{31}$ to $R_{34}$ is preferably a benzyl or phenetyl group, and the substituent group which is introduced onto its aromatic ring is allowed to the same as the above substituent group that is introduced onto the aryl group represented by $R_{31}$ to $R_{34}$ in the same formula [II'].

The heterocyclic group represented by $R_{31}$ to $R_{34}$ is a pyridyl or pyrimidyl group, for example, and the substituent group which is introduced onto its heterocyclic ring is allowably the same as that on the above aryl group represented by $R_{31}$ to $R_{34}$ in the same formula [II'].

The group represented by $R_{31}$ to $R_{34}$ is preferable to an alkyl or aryl group. And the barbituric or thiobarbituric acid rings shown in General Formula [II'] have preferably at least one substituent group among carboxy, sulfo and sulfamoyl groups, respectively, in a symmetrical form especially.

Typical compounds represented by General Formula [II'] are exemplified as follows, but compounds used in the invention are not limited to them.

(C-1)

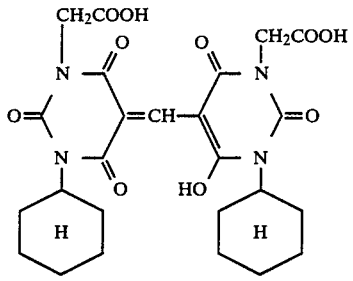

(C-2)

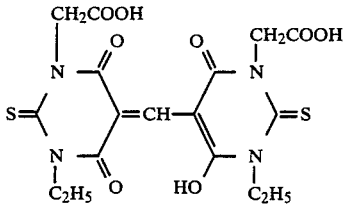

(C-3)

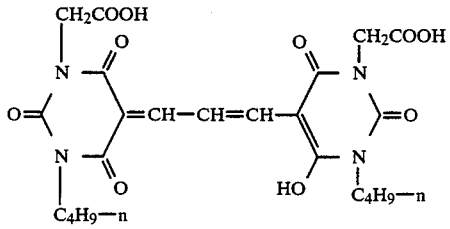

(C-4)

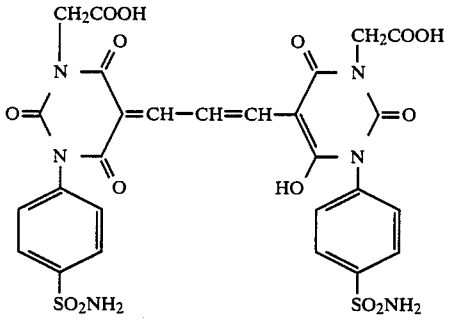

(C-5)

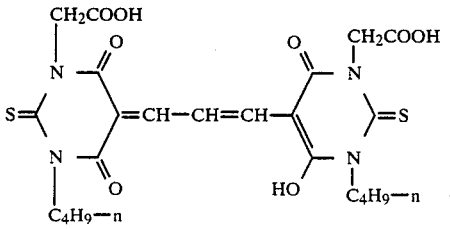

-continued (C-6)

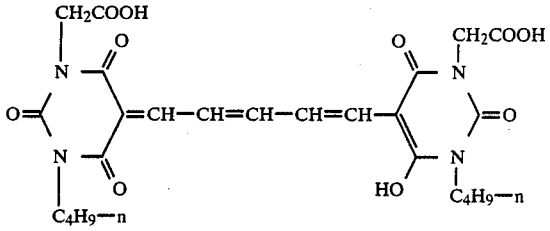

(C-7)

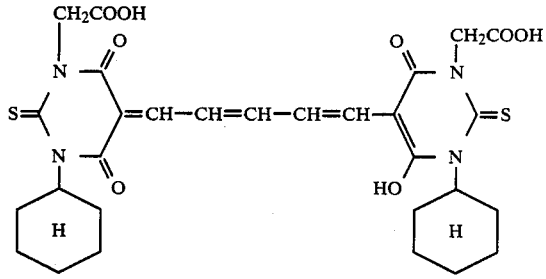

In General Formula [II'']:

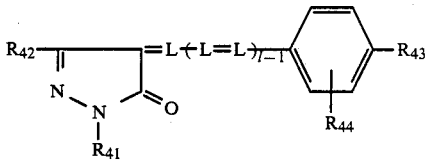

l is the integer 1 or 2; L is a methin group; $R_{41}$ is similar to $R_6$ and $R_6'$ in General Formula [II], but preferably is an alkyl or aryl group, and said aryl group preferably has at least one sulfo group.

$R_{42}$ in General Formula [II''] is allowed to be substituted by any substituent group represented by $R_7$ or $R_7'$ in General Formula [II], preferably by an alkyl, carboxy, alkoxycarbonyl, carbamoyl, ureido, acylamino, imido, or cyano group.

$R_{43}$ in General Formula [II''] is allowably an $-OZ_1$, or

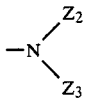

group, where each of $Z_1$, $Z_2$ and $Z_3$ is a hydrogen atom, or an alkyl group; and $Z_2$ and $Z_3$ are allowed to be the same, and/or to combine with each other to form a ring.

The alkyl group represented by $Z_1$, $Z_2$ or $Z_3$ is for example, a methyl, ethyl, butyl, hydroxyalkyl such as hydroxyethyl, alkoxyalkyl such as β-ethoxyethyl, carboxyalkyl such as β-carboxyethyl, alkoxycarbonylalkyl such as β-ethoxycarbonylethyl, cyanoalkyl such as β-cyanoethyl, or sulfoalkyl such as β-sulfoethyl and γ-sulfopropyl group.

$Z_2$ and $Z_3$ are allowed to join together to form a 5- or 6-membered ring such as a morpholino, piperidino, or pyrrolidino group.

$R_{44}$ in General Formula [II''] is a hydrogen or chlorine atom, or an alkyl or alkoxy group, and said alkyl group is for example, a methyl or ethyl group, and said alkoxy group is for example, a methoxy or ethoxy group.
Typical compounds represented by General Formula [II''] are exemplified as follows, but compounds used in the invention are not limited to them.
(D-1)
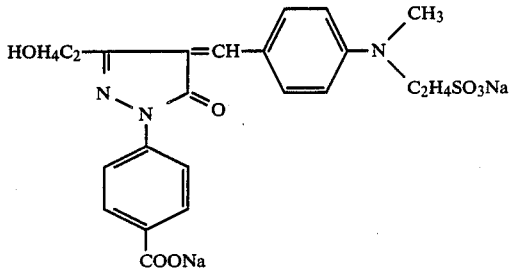
(D-2)
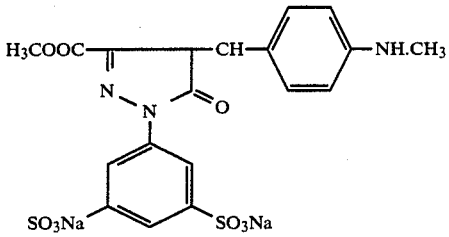
(D-3)
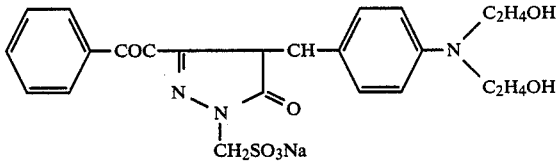
(D-4)
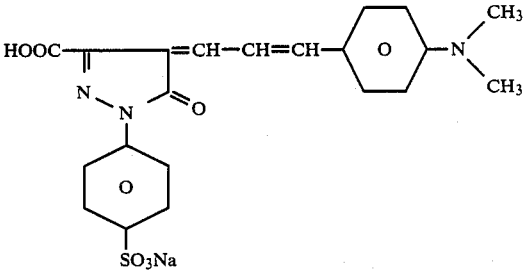
(D-5)
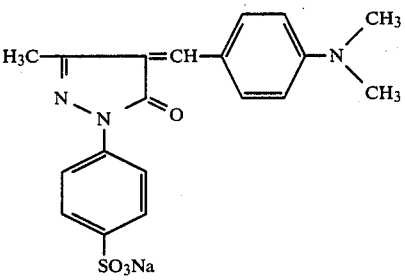
(D-6)
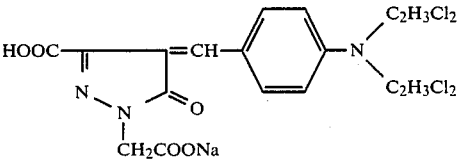

-continued (D-7)

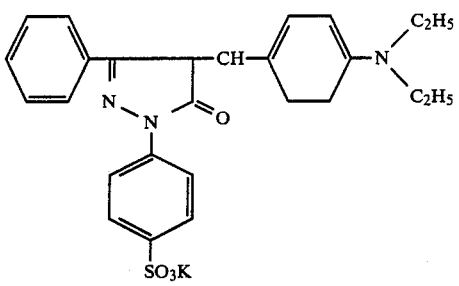

(D-8)

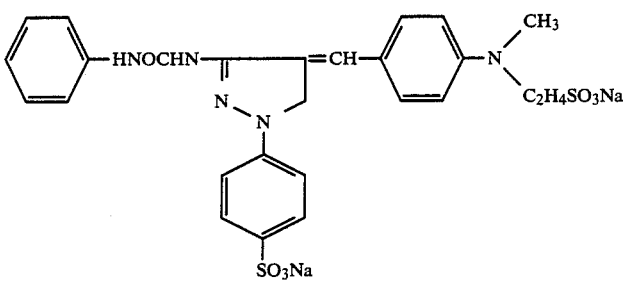

Each of compounds represented by General Formula [I], [II], [II'], or [II''], can be synthesized according to a certain synthetic method described in the specification of U.S. Pat. Nos. 3,575,704, 3,247,127, 3,540,887 or 3,653,905; or Japanese Patent O.P.I. Publication Nos. 85130/1973, 99620/1974, 111640/1984, 111641/1984 or 170838/1984.

For the purpose of processing the photosensitive material with the washless stabilizer in the presence of a compound represented by General Formula [I], [II], [II'] or [II''], said compound is allowed either to be directly added to said washless stabilizer, or to be introduced by adding to a forebath and attached to the photosensitive material there. Alternatively, it however is preferable from the practical viewpoint that said compound is introduced into said washless stabilizer by incorporating into the photosensitive material. When said compound is incorporated into the photosensitive material, said compound is allowed to be contained in a silver halide emulsion layer or any other hydrophilic colloid layer of said photosensitive material. Alternatively, it can be contained in said photosensitive material by means that an organic or inorganic alkali salt of the compound of the invention is dissolved into water to make an appropriate concentration of an aqueous dye solution, added to a coating solution, and coated onto said photosensitive material according to a certain well-known procedure. The amount of said compound to be coated is to be 1 to 800 mg, preferably 2 to 200 mg per square meter of the photosensitive material. In case of the addition to said washless stabilizer, the content of said compound is to be 0.005 to 200 mg, preferably 0.01 to 50 mg per liter of the solution.

Among compounds represented by General Formula [I], [II], [II'], or [II''], compounds represented by General Formula [II] are especially preferable. Two or more of these compounds are also allowably used in combination with each other.

In case of the means that a compound of the invention represented by General Formula [I], [II], [II'], or [II''] is contained in the photosensitive material, and eluted with the washless stabilizer, its eluting concentration obviously depends on the supplied amount of said stabilizing solution per unit area of said photosensitive material, but is also affected by the pretreating conditions before said stabilizing process, including the time and the temperature of treatment with the color developer and the bleach-fixer.

An excessively long treating time or an excessively high treating temperature of the color developer or the bleach-fixer is undesirable because said compound is eluted prematurely.

Therefore the time for the pretreatment before the stabilizing process is not to exceed 8 minutes, desirably 6 minutes, and most desirably 4½ minutes. As for the supplementary amount of processing solutions in case of a continuous processing, the overall amount of them in the color developing and bleach-fixing processes before washless stabilizing process is not to exceed 1000 ml, preferably 600 ml per square meter of the photosensitive material. The supplementary amount of the washless stabilizer is not to exceed 2000 ml, desirably 1000 ml, and most desirably 500 ml per square meter of the photosensitive material.

In case that a compound represented by General Formula [I], [II], [II'], or [II''] is contained in the photosensitive material, the eluted concentration of said compound in the washless stabilizer comes to a similar level to that in case that said compound is directly added to said stabilizing solution, if the above treating temperature, treating time, and supplementary amounts are adopted. The means that the compound is directly added to the washless stabilizer is preferable.

The sulfite compound which is preferably contained in the washless stabilizer in the invention is allowably any organic or inorganic compound so long as it liberates sulfite ion, but is preferably an inorganic sulfite such as sodium sulfite, potassium sulfite, ammonium sulfite, ammonium bisulfite, potassium bisulfite, sodium bisulfite, sodium metabisulfite, potassium metabisulfite, ammonium metabisulfite, or hydrosulfites.

The silver ions relating to the invention include not only simple silver ions but also those of such a silver complex salt as a silver thiosulfate complex salt, a silver thiocyanate complex salt, a silver cyanide complex salt, a silver halide complex salt and the like. The meaning of 'silver ions in an amount of not less than 20 mg per liter' is that, in the case of a silver complex salt, the amount thereof is not less than 20 mg per liter in terms of the silver ions thereof.

In the invention, it is essential that an amount of silver ions in a washless stabilizer is to be not less than 20 mg per liter and more preferably within the range of from 40 mg to 4 g per liter.

Said sulfite salt is to be added to said stabilizer so as to amount to a concentration of at least $1\times10^{-3}$ mole, preferably $5\times10^{-3}$ to $10^{-1}$ mole per liter of the stabilizer. Said sulfite salt is allowed to be directly added to said stabilizing solution, but preferably to be added to the supplementary wash-substituent stabilizing solution. It is advisable that said sulfite salt is to be added in the form of the adduct of an aldehyde compound of the invention.

In the invention, the process of treating with a processor which has a fixing ability means the process carried out with use of a fixing bath or a bleach-fixing bath for the purpose of fixing the photosensitive material, and is usually carried out after the developing process. As to said processor which has said fixing ability, a detailed description is given later.

In the invention, the wording, "and then is not substantially washed" implies that, if the concentration of the fixer or bleach-fixer which is brought into the front bath for the stabilizing process does not come below 1/2000 or so, the photosensitive material is allowed to be submitted to treatments including a very short-time rinsing, or auxiliary washing by a single bath, or a multiple-bath countercurrent system, or a washing by a wash-accelerating bath.

In the invention, the treatment with a washless solution means that the photosensitive material is treated to be stabilized immediately after the treatment with the processor which has a fixing ability, and hence is not substantially submitted to any washing process. The processor then used for the stabilizing treatment is referred to as the washless stabilizer, and the processing bath is as the stabilizing bath or the stabilizing vessel.

Said stabilizing bath in the invention is allowably single, but preferably double or triple, and at most of less than 9 units. As for a given amount of the supplementary stabilizer, the more the baths are there, the less the concentration of contaminating components in the final stabilizing bath comes out.

As abovementioned, said treatment with the washless stabilizer of the invention is carried out immediately after the fixing treatment. Thus in the invention, the washing water containing a compound of the invention constitutes said washless stabilizer.

Compounds to be added to said washless stabilizer are especially preferable to be ammonium compounds.

Such compounds are substantially selected out of various inorganic or derived ammonium compounds, including ammonium hydroxide, ammonium bromide, ammonium carbonate, ammonium chloride, ammonium hypophosphite, ammonium phosphate, ammonium phosphite, ammonium fluoride, ammonium hydrogen fluoride, ammonium fluorobarate, ammonium arsenate, ammonium hydrogen carbonate, ammonium hydrogen fluoride, ammonium hydrogen sulfate, ammonium sulfate, ammonium idodide, ammonium nitrate, ammonium pentaborate, ammonium acetate, ammonium adipate, ammonium trilaurincarbonate, ammonium benzoate, ammonium carbamate, ammonium citrate, ammonium diethyldithiocarbamate, ammonium formate, ammonium hydrogen malate, ammonium hydrogen oxalate, ammonium hydrogen phthalate, ammonium hydrogen tartrate, ammonium thiosulfate, ammonium sulfite, ammonium ethylenediaminetetraacetate, ammonium ferric ethylenediaminetetraacetate, ammonium lactate, ammonium malate, ammonium maleate, ammonium oxalate, ammonium phthalate, ammonium picrate, ammonium pyrrolidinedithiocarbamate, ammonium salicylate, ammonium succinate, ammonium sulfanilate, ammonium tartarate, ammonium thioglycolate, and ammonium 2,4,6-trinitrophenolate. These compounds are allowed to be used singly or in a multiple combination.

The adding amount of said ammonium compound is to range from 0.001 to 1.0 mole, preferably from 0.002 to 0.2 moles per liter of the stabilizer.

The pH of the washless stabilizer in the invention is to range from 3.5 to 9.5, but preferably to be adjusted between 3.5 and 9.0 in terms of preventing occurrence of precipitate for a purpose of the invention. Furthermore for the purpose of the invention, it is desirable that the washless stabilizer contains a sequestering agent which has a sequestering stability constant higher than 8 against iron ion.

Said sequestering stability constant is referred to the constant generally known according to L. G. Sillén and A. E. Martell: "Stability Constants of Metal-ion Complexes", the Chemical Society, London (1964); S. Chaberek and A. E. Martell: "Organic Sequestering Agents", Wiley (1959); etc.

The sequestering agent with a sequestering stability constant higher than 8 against iron ion, which is preferably used in the washless stabilizer in the invention, is for example, a certain organic carboxylic acid sequestering agent, organic phosphoric acid sequestering agent, inorganic phosphoric acid sequestering agent, or a certain polyhydroxy compound. The above iron ion is referred to the ferric ($F^{3+}$) ion.

Such a sequestering agent is, for example, preferably ethylenediaminediorthohydroxyphenylacetic acid, diaminopropanetetraacetic acid, nitrilotriacetic acid, hydroxyethylethylenediaminetriacetic acid, dihydroxyethylglycine, ethylenediaminediacetic acid, ethylenediaminedipropionic acid, iminodiacetic acid, diethylenetriaminpentaacetic acid, hydroxyethyliminodiacetic acid, diaminopropanoltetraacetic acid, trans-cyclohexanediaminetetraacetic acid, glycoletherdiaminetetraacetic acid, ethylenediaminetetraquismethylenesulfonic acid, nitrilotrimethylenesulfonic acid; 1-hydroxyethylidene-1,1'-disulfonic acid; 1,1'-diphosphonoethane-2-carboxylic acid; 2-phosphonobutane-1,2,4-tricarboxylic acid; 1-hydoxy-1-phosphonopropane-1,2,3-tricarboxylic acid; catechol-3,5-disulfonic acid; sodium pyrophosphate, sodium tetrapolyphosphate, or sodium hexamethaphosphate; especially preferably diethylenetriaminepentaacetic acid, nitrilotriacetic acid, 1-hydroxyethylidene-1,1-disulfonic acid, or their salts. However sequestering agents used in the invention are not limited to them.

The above sequestering agent is to be used in the range of 0.01 to 50 g, preferably 0.05 to 20 g per liter of the washless stabilizer to obtain good results.

Besides the above compounds, there are generally known compounds which can be added to the washless stabilizer, including organic salts such as citrates, acetates, succinates, oxalates and benzoates; pH controlling agents such as phosphates, borates, hydrochlorides and sulfates; antifungal agents such as phenol derivatives, catechol derivatives, imidazole derivatives, triazole derivatives, thiabendazole derivatives, organic chlorine compounds; antifungal agents known as slime controlling agents in the paper and pulp industry; optical brightening agents; surfactants; antiseptic preservativjes; and metallic salts such as Bi, Mg, Zn, Ni, Al, Sn, Ti and Zr salts. Any of these compounds is allowed to be added to the stabilizer in any combination with each other provided that it is necessary to the maintenance of pH of the stabilizing bath, and that it adversely affects the preservative stability of the color photographic image and the prevention of the occurrence of precipitate.

The stabilizing process is to be carried out at temperatures ranging from 15° to 60° C., preferably from 20° to 45° C. It is also to be carried out within a time as short as possible in terms of efficiency, usually within ⅓ to 10 minutes, preferably within 1 to 3 minutes. In case of the stabilizing process in a multi-bath system, it is desirable that the treating time in every bath is increased step by step from the front through the final. It is especially desirable that every bath takes time 20 to 50% more than the preceding bath. Although, in general, no washing process is necessary after the stabilizing process in the invention, a linsing or surface washing process with a small amount of water within a very short time is allowed arbitrarily if necessary.

In case of a mult-bath countercurrent system, the washless stabilizer is preferably supplied into the final bath and allowed to overflow the front bath. As a matter of course, the stabilizing process is also allowably carried out in a single bath. The above compound is allowed to be added by directly putting in the stabilizing bath in the form of its concentrated solution, by patting in the supplying reservoir of the stabilizer together with other additive agents, or by any other appropriate procedure.

It is desirable that the photosensitive material of the invention contains a cyan coupler represented by General Formula [III] or [IV] in view of the preservability of the cyan dye in the dark:

General Formula [III]

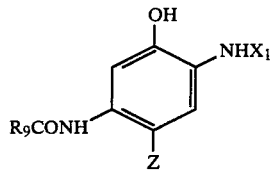

General Formula [IV]

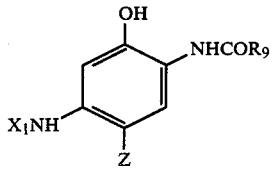

where $X_1$ is a $—COR_{10}$,

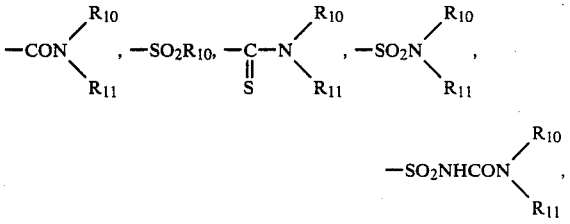

$—CONHCOR_{10}$, or $—CONHSO_2R_{10}$ (where $R_{10}$ is an alkyl, alkenyl, cycloalkyl, aryl or heterocyclic group; $R_{11}$ is a hydrogen atom, or an alkyl, alkenyl, cycloalkyl, aryl, or heterocyclic group; and $R_{10}$ and $R_{11}$ are allowably combined with each other to form a 3- to b-membered ring); $R_9$ is a ballast group; Z is a hydrogen atom, or a group which can be split by the coupling reaction with the oxidation product of an aromatic primary amine color developing agent.

Typical cyan coupler compounds represented by General Formula [III] or [IV] are exemplified as follows:

(1)

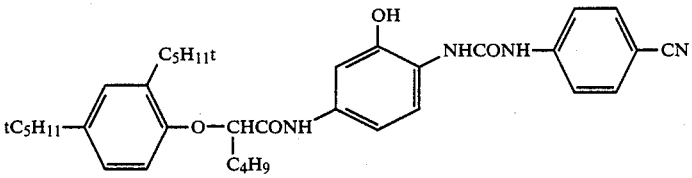

(2)

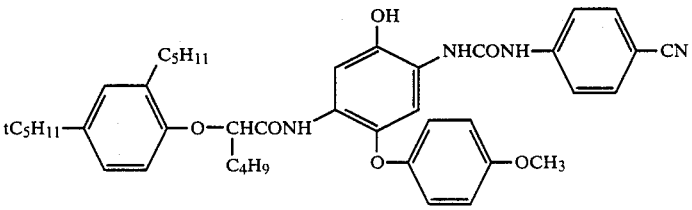

-continued
(3)
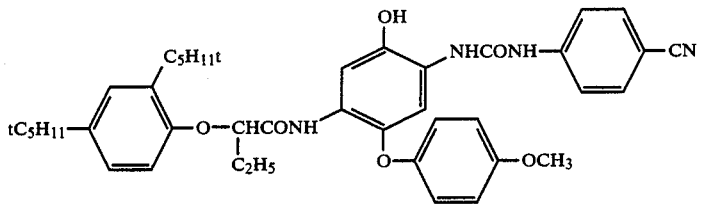
(4)
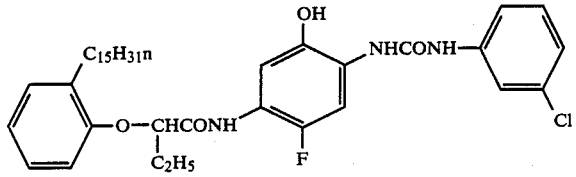
(5)
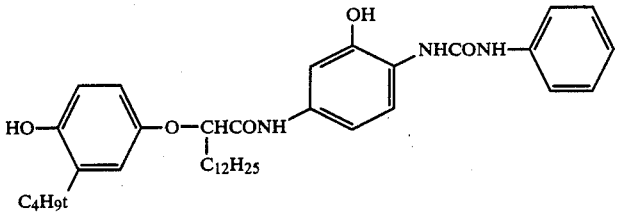
(6)
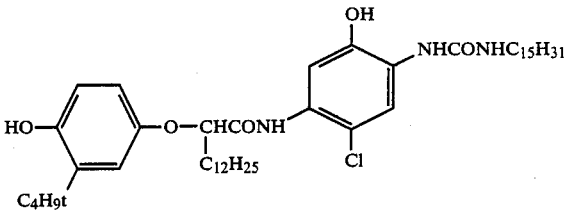
(7)
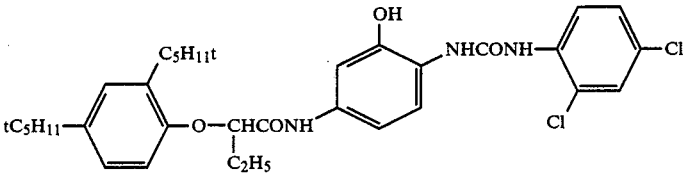
(8)
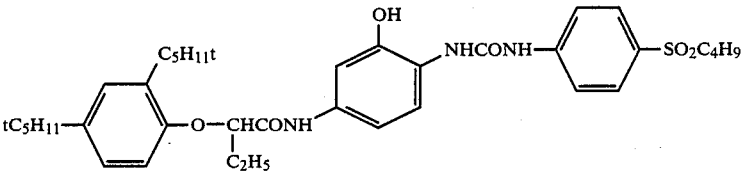
(9)
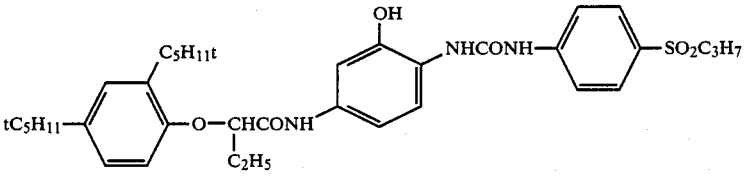
(10)
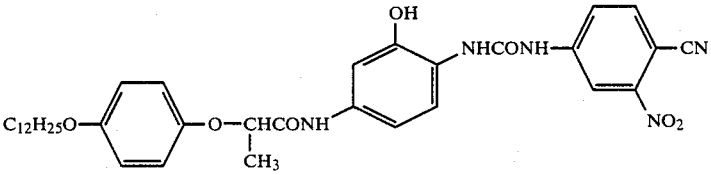

-continued
(11)
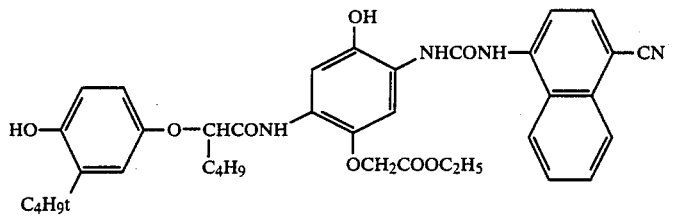
(12)
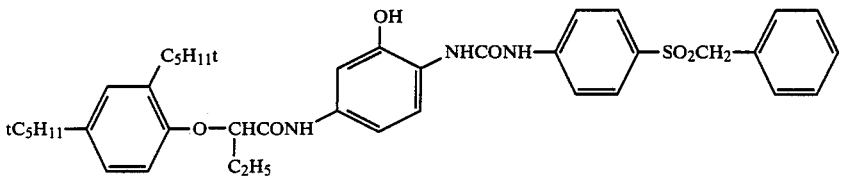
(13)
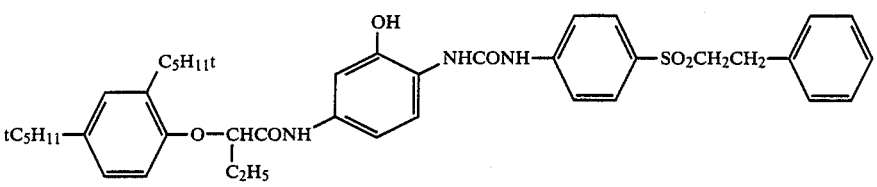
(14)
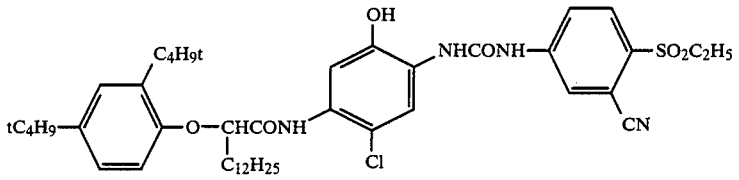
(15)
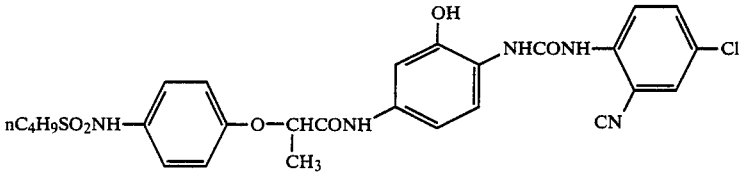
(16)
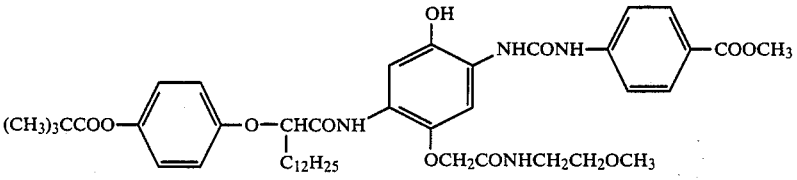
(17)
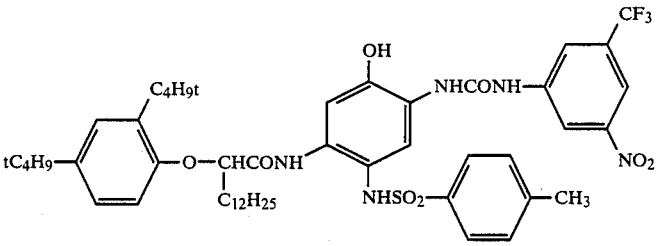
(18)
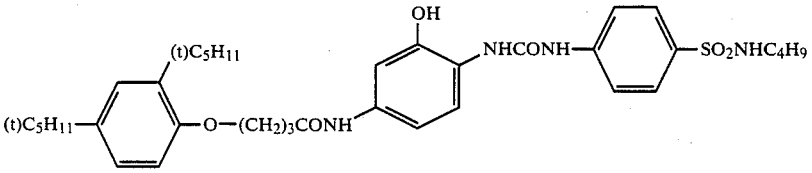

-continued
(19)
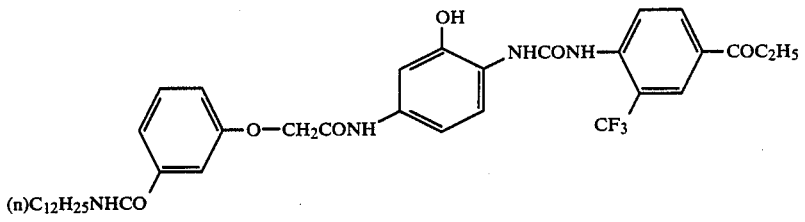
(20)
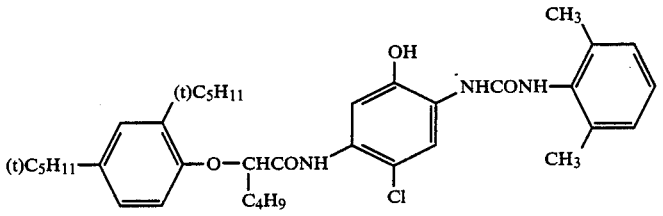
(21)
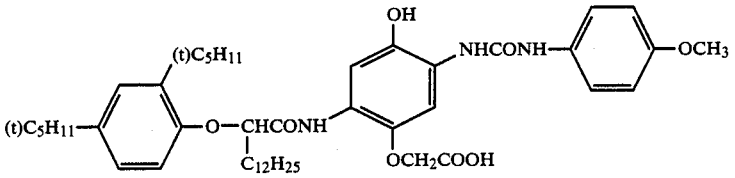
(22)
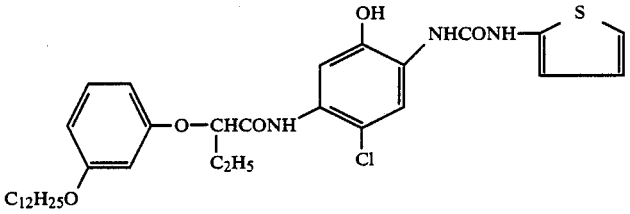
(23)
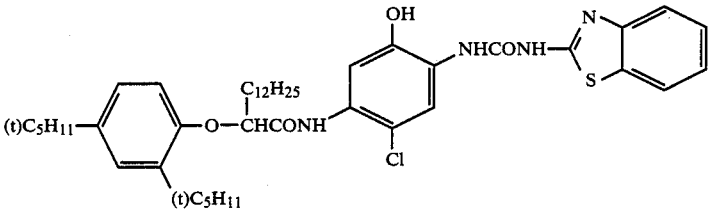
(24)
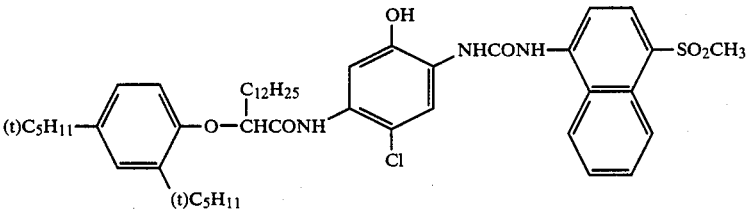
(25)
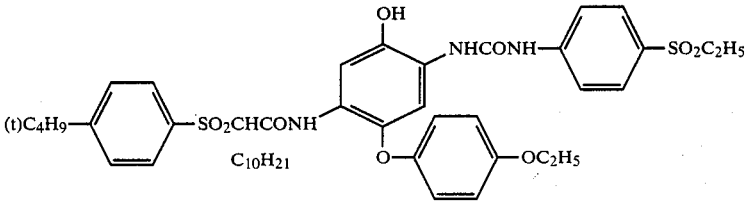

-continued
(26)
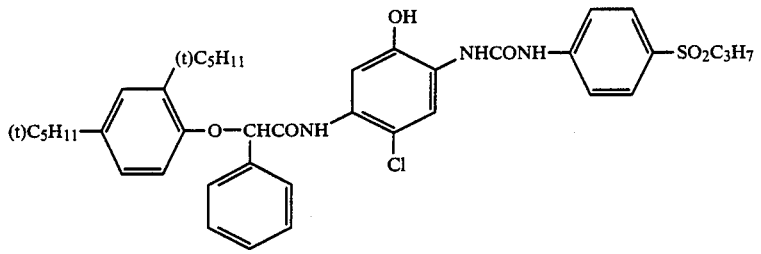
(27)
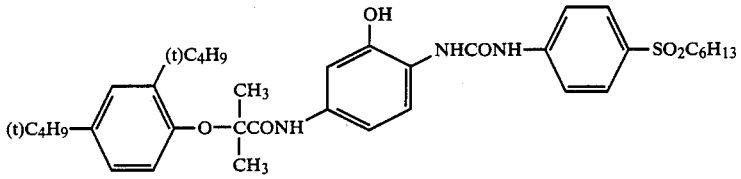
(28)
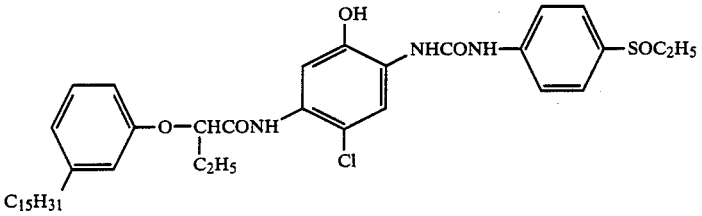
(29)
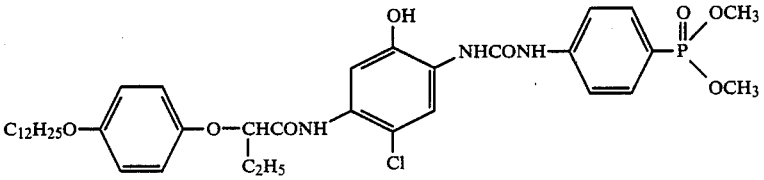
(30)
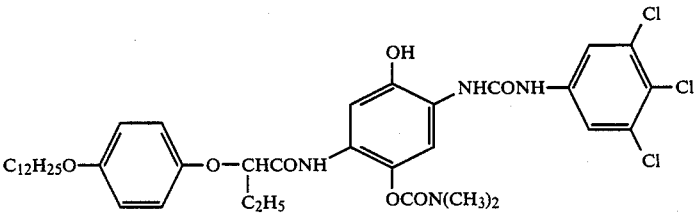
(31)
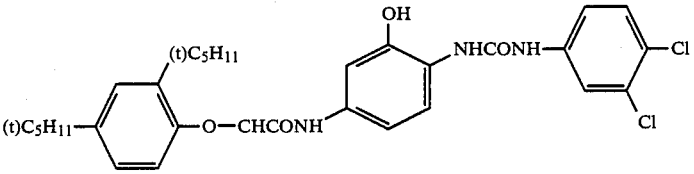
(32)
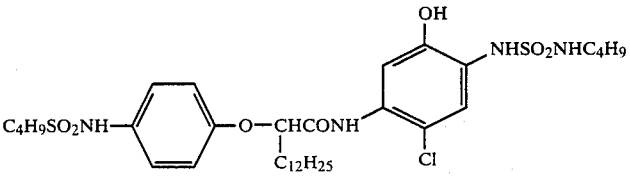

-continued
(33)
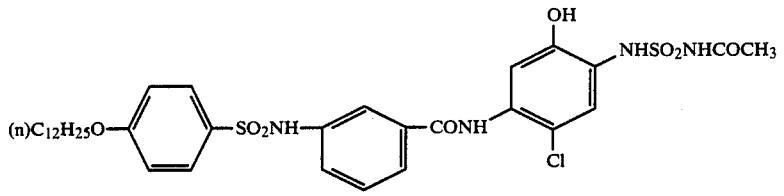
(34)
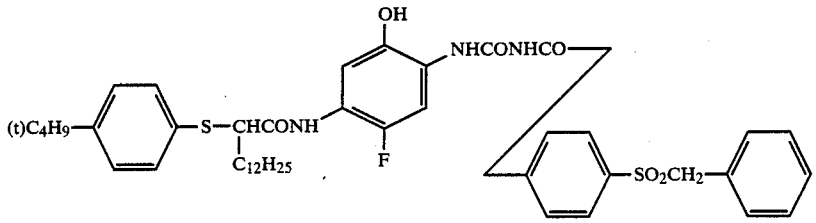
(35)
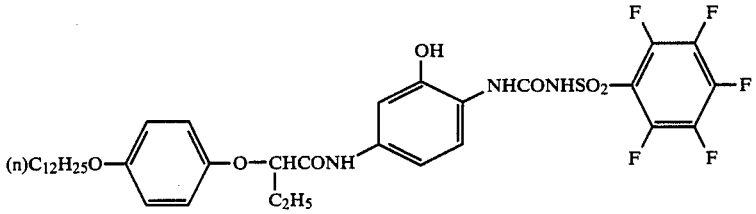
(36)
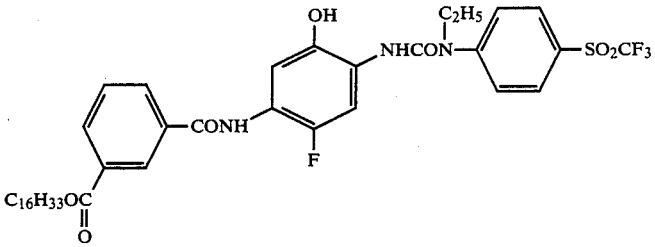
(37)
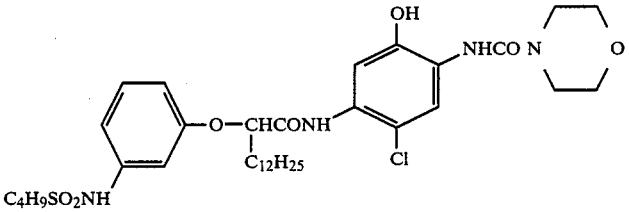
(38)
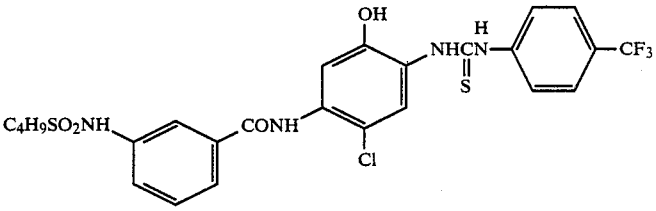
(39)
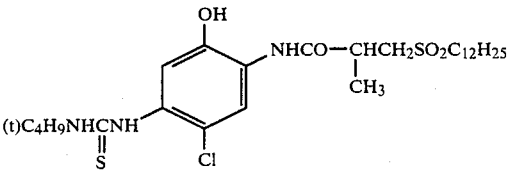

-continued
(40)
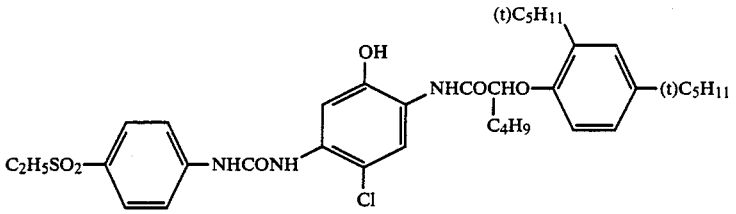
(41)
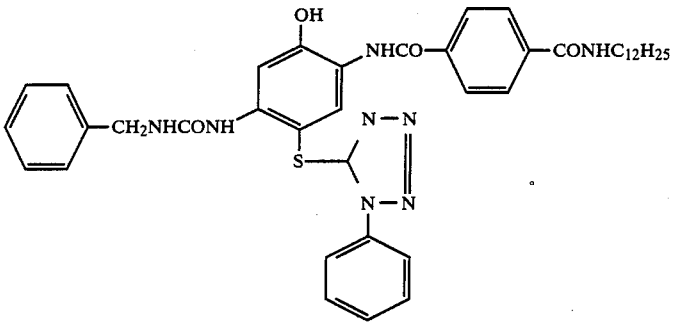
(42)
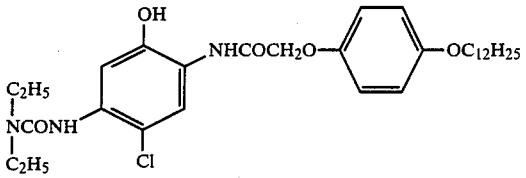
(43)
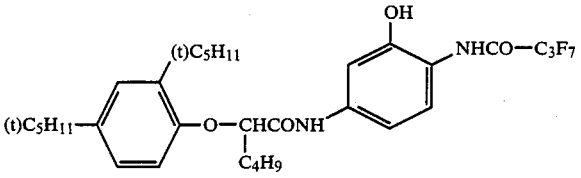
(44)
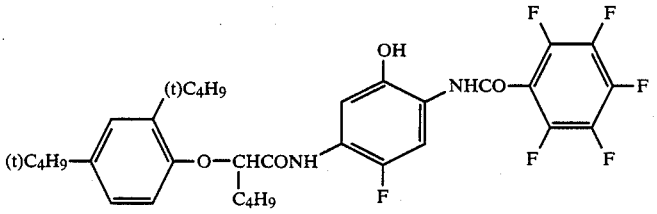
(45)
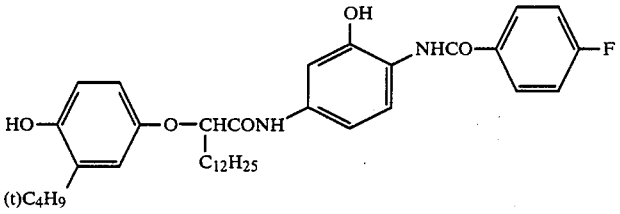
(46)
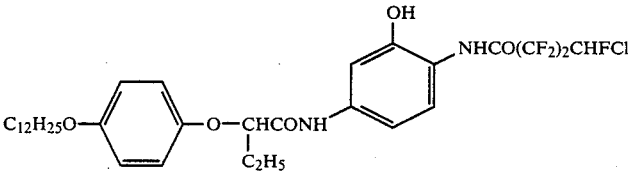

-continued
(47)
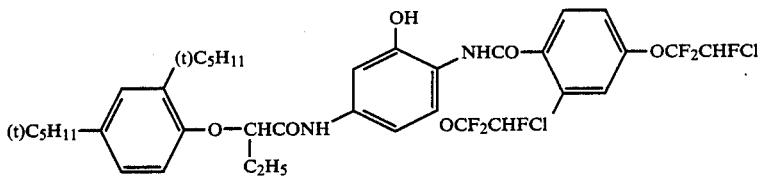
(48)
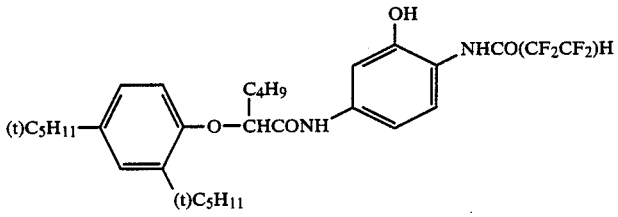
(49)
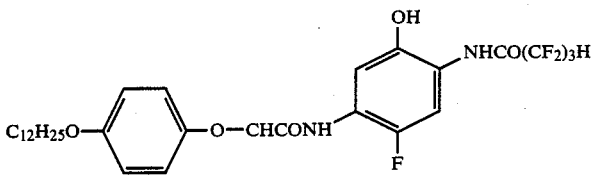
(50)
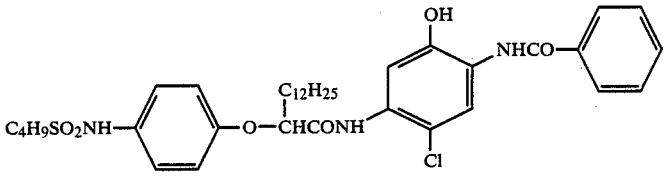
(51)
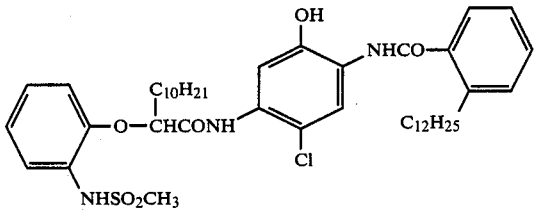
(52)
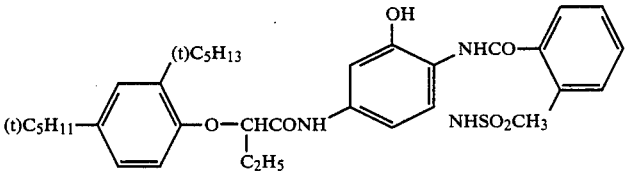
(53)
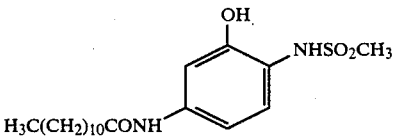
(54)
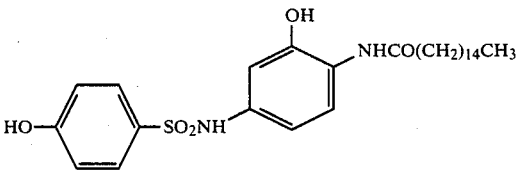

-continued
(55)
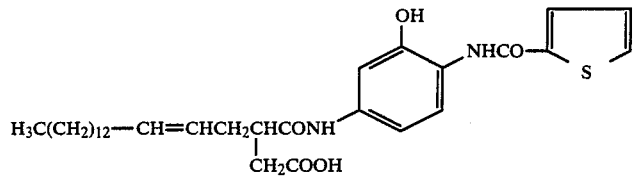
(56)
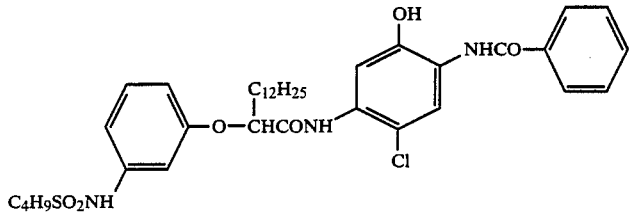
(57)
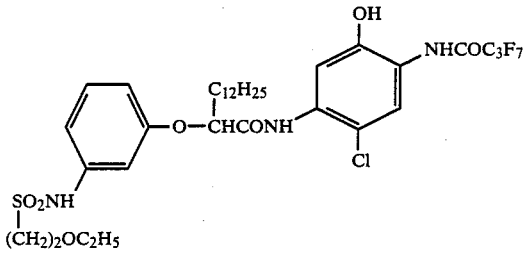
(58)
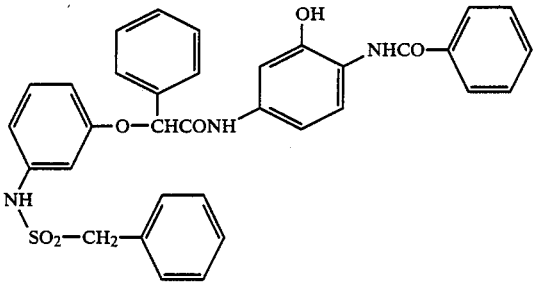
(59)
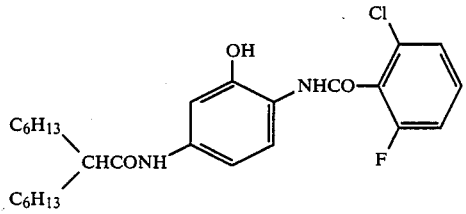
(60)
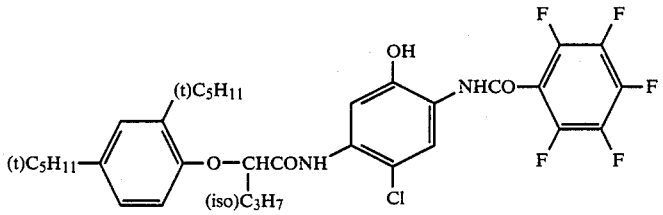
(61)
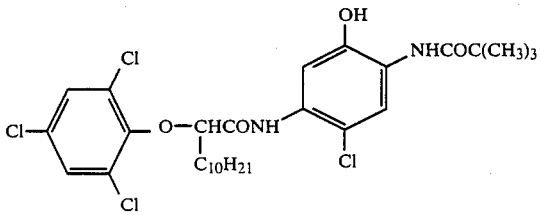

-continued
(62)
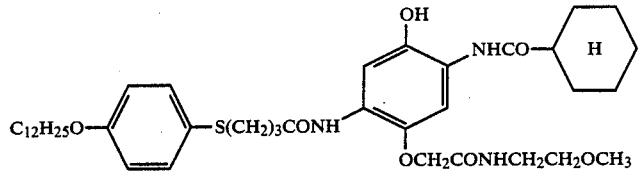
(63)
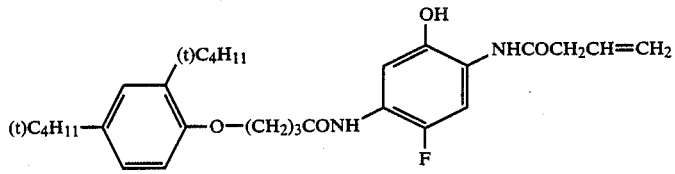
(64)
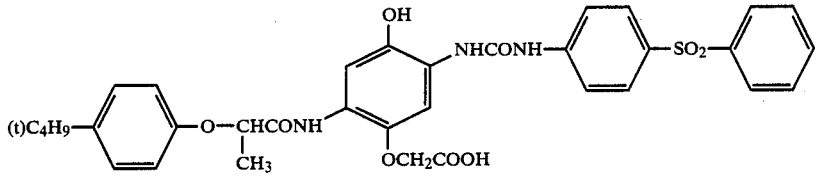
(65)
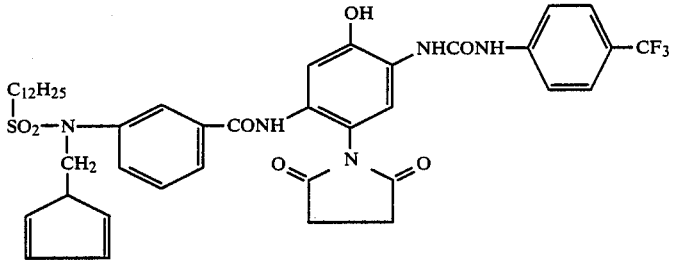
(66)
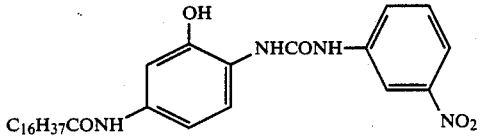
(67)
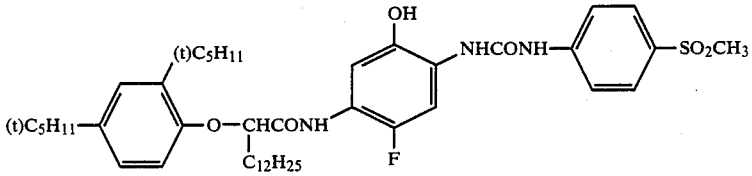
(68)
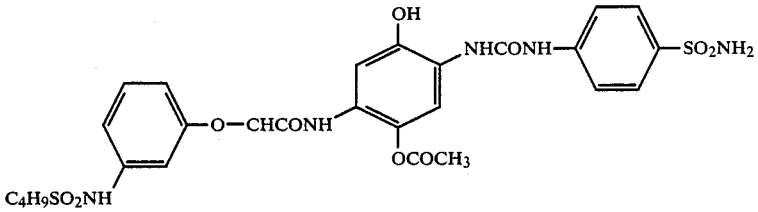
(69)
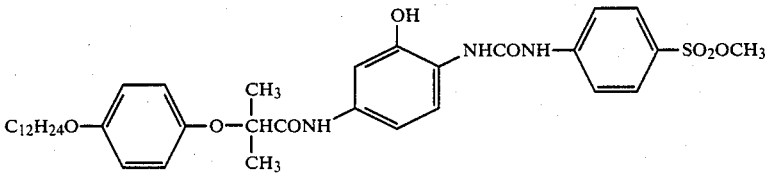

-continued (70)

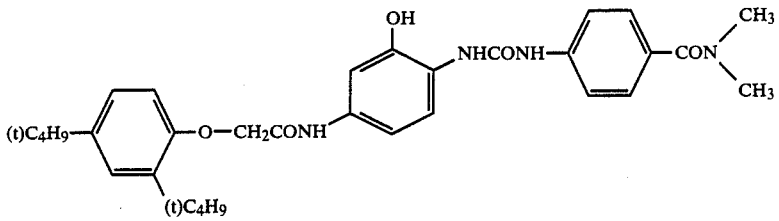

(71)

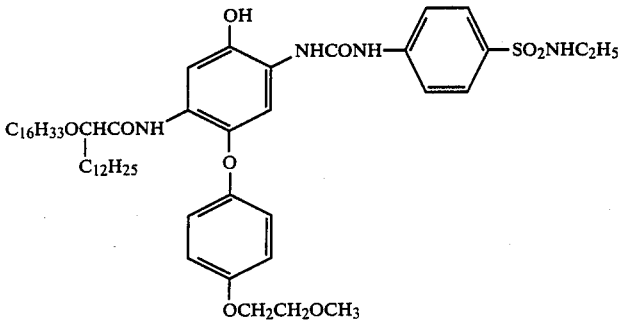

(72)

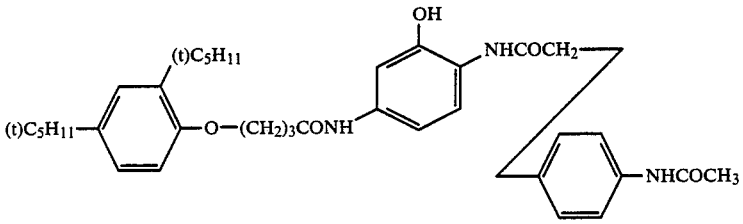

As substantial exampls of cyan couplers and the like preferably used in the photosensitive material of the invention, compounds exemplified in Japanese Patent Application No. 57903/1983 which was issued by the applicant of the present invention can be cited.

Furthermore, it is most desirable that a cyan coupler represented by General Formula [V] is used in the photosensitive material of the invention in view of the preservability of the cyan dye in the dark:

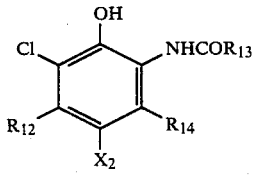

where one of $R_{12}$ and $R_{14}$ is a hydrogen atom, and the other is a linear or branched alkyl group with at least 2 to 12 carbon atoms; X is a hydrogen atom, or a group which can be split by a coupling reaction; and $R_{13}$ is a ballast group.

Typical cyan coupler compounds represented by General Formula (V) are exemplified in the following table. As useful compounds other than those in the table, compounds exemplified in Japanese Patent Application No. 95613/1984 which was issued by the applicant of the present invention, for example.

| Color No. | $R_{12}$ | $X_2$ | $R_{13}$ | $R_{14}$ |
|---|---|---|---|---|
| (24) | $-C_2H_5$ | —Cl | 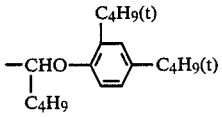 | —H |
| (25) | $-C_2H_5$ | —H | 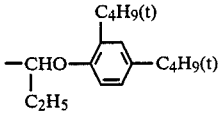 | —H |

[Exemplified Compounds]

| Coupler No. | $R_{12}$ | $X_2$ | $R_{13}$ | $R_{14}$ |
|---|---|---|---|---|
| (18) | $-C_2H_5$ | —Cl | 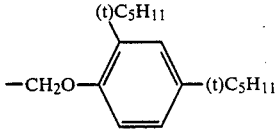 | —H |

-continued

[Exemplified Compounds]

| Coupler No. | $R_{12}$ | $X_2$ | $R_{13}$ | $R_{14}$ |
|---|---|---|---|---|
| (19) | $-C_2H_5$ | 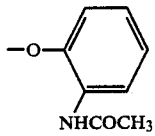 | 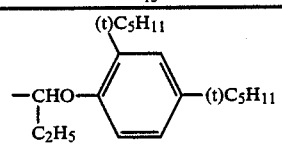 | $-H$ |
| (20) | 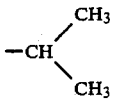 | $-Cl$ | 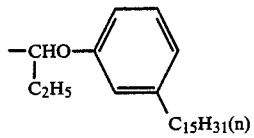 | $-H$ |
| (21) | $-C_2H_5$ | $-Cl$ | 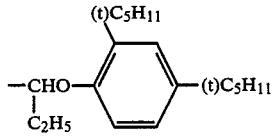 | $-H$ |
| (22) | $-C_2H_5$ | $-Cl$ | 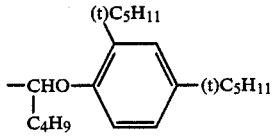 | $-H$ |
| (23) | $-C_4H_9$ | $-F$ | 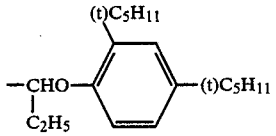 | $-H$ |

The silver halide emulsion useful in the photosensitive material of the invention is allowed to be made using any of silver halide compounds including silver chloride, silver bromide, silver iodide, silver chlorobromide, silver chloroiodide, silver iodobromide, and silver chloroiodobromide. As a protective colloid for the silver halide, there can be used materials including natural materials such as gelatin as well as various synthetic materials. The silver halide emulsion is allowed to contain common photographic additives such as stabilizers, sensitizers, hardeners, sensitizing dyes, and surfactants.

As a support of the photosensitive material of the invention, there can be any of materials including polyethylene-coated paper, triacetate film, polyethylene terephthalate film, and three-colored polyethylene terephthalate film.

As aromatic primary amine color developing agents used in the color developer of the photographic material in the invention, there are included well-known compounds which are widely used in various color photographic processes, and are aminophenol derivatives, and p-phenylenediamine derivatives, for example. These compounds are used in the form of salt such as hydrochloride and sulfate rather than in the form of free amine in terms of stability. They are generally used at concentrations from about 0.1 g to about 30 g, preferably from about 1 g to about 1.5 g per liter of the color developer.

As aminophenol derivatives, there are included o-aminophenol, p-aminophenol, 5-amino-2-oxytoluene, 2-amino-3-oxytoluene and 2-oxy-3-amino-1,4-dimethylbenzene, for example.

Aromatic primary amines especially useful as a color developing agent are N,N'-dialkyl-p-phenylenediamine compounds, whose alkyl and phenyl groups are allowably substituted with optional groups. Among these compounds, there are cited as most useful, N,N'-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)-toluene, N-ethyl-N-$\beta$-methanesulfonamidoethyl-3-methyl-4-aminoaniline sulfate, N-ethyl-N-$\beta$-hydroxyethylaminoaniline, 4-amino-3-methyl-N,N'-diethylaniline, and 4-amino-N-(2-methoxyethyl)-N-ethyl-3-methylaniline-p-toluenesulfonate.

Besides the above aromatic primary amines as a color developing agent, the color developer can optionally contain various components which are commonly used in color developers, including alkali agents such as sodium hydroxide, sodium carbonate, and potassium carbonate; alkali metal sulfites, alkali metal bisulfites, alkali metal thiocyanates, alkali metal halides, benzyl alcohol, water softeners, and thickeners. The pH of the color developer is usually higher than 7, and most generally about 10 to about 13.

The fixer used in the invention can contain as a fixing agent, for example, thiosulfates (described in Japanese Patent O.P.I. Publication No. 185435/1982), thiocyanates (described in the specification of British Pat. No. 565135, and Japanese Patent O.P.I. Publication No. 137143/1979), halides (described in Japanese Patent O.P.I. Publication No. 130639/1977), thioethers (described in the specification of Belgian Patent No. 626970), or thioureas (described in the specification of British Pat. No. 1189416). Among these fixing agents, thiosulfates are most effective in achieving the purpose of the invention. In case that the processor which has a fixing ability is a bleach-fixer in the invention, organic acid ferric complex salts (described in Japanese Patent Examined Publication Nos. 38895/1979 and 500704/1980; and Japanese Patent O.P.I. Publication Nos. 52748/1981 and 149358/1984) can be used as the bleaching agent.

In case that the processor which has a fixing ability is a processor for the purpose of fixing treatment, and is preceded by a bleaching process, all types of bleaching agents can be used as the bleaching agent, including ferricyanides and ferric chloride (described in the specification of British Pat. No. 736881, and Japanese Patent Examined Publication No. 44424/1981), persulfuric acid (described in the specification of West German Pat. No. 2141199), hydrogen peroxide (described in Japanese Patent Examined Publication Nos. 11617/1983 and 11618/1983), and organic acid ferric complex salts (described in Japanese Patent O.P.I. Publication Nos. 70533/1982 and 43454/1983; and the specification of Japanese Patent Application No. 40633/1983.

In the invention, silver is allowed to be recovered from soluble silver complex salt-containing processors including the fixer and bleach-fixer, as well as the washless stabilizer, making use of well-known means such as the electrolytic method (described in the specification of French Pat. No. 2,299,667), the precipitating method (described in Japanese Patent O.P.I. Publication No. 73037/1977, and the specification of West German Pat. No. 2,331,220), the ion exchanging method (described in Japanese Patent O.P.I. Publication No. 17114/1976, and the specification of West German Pat. No. 2,548,237), and the metal substituting method (described in the specification of British Pat. No. 1,353,805), for example.

EXAMPLES

Further description of the invention is given on the basis of examples as follows, although the invention is not limited to the case of these examples.

Example 1

The layers described below were coated on a support of polyethylene-coated paper in the order described to make a photosensitive material.

The above polyethylene-coated paper is a piece of 170 g/m$^2$ fabricated free sheet which is made through the following procedures: (1) A mixture of 200 wt. parts of polyethylene with an average molecular weight of 100,000, and a density of 0.95; and 20 wt. parts of polyethylene with an average molecular weight of 2000, and a density of 0.80 with 6.8 wt % of anatase-type titanium dioxide, is applied to cover the paper by an extrusion-coating process to form a surface covering layer 0.035 mm thick, and then (2) the same mixture is applied onto the back side of the paper similarly to form a back covering layer 0.040 mm thick. covering layer 0.040 mm thick. Then, (3) the surface coating polyethylene layer is pretreated with corona irradiation, and then covered with the layers abovementioned.

First Layer:

The first layer is a blue-sensitive silver halide emulsion layer composed of a siler chlorobromide emulsion having a silver bromide content of 95 mole %. Said emulsion contains 350 g of gelatin per mole of silver halide; is sensitized by $2.5\times10^{-4}$ moles (per mole of silver halide) of a sensitizing dye represented by the following formula:

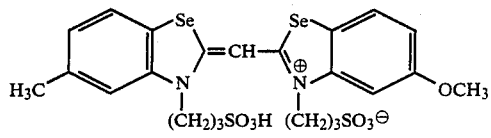

with use of isopropyl alcohol as solvent; and contains a dispersed solution (in dibutyl phthalate) of both 2,5-di-tert-butylhydroquinone, and α-[4-(1-benzyl-2-phenyl-3,5-dioxo-1,2,4-tiazolidyl)]-α-pivalyl-2-chloro-5-[γ-(2,4-di-tert-amylphenoxy)butylamido]acetanilide (as a yellow coupler; $2\times10^{-1}$ moles per mole of silverhalide); and then coated at a rate of 330 mg of silver per square meter of the photosensitive material.

Second Layer:

The second layer is a geletin layer which has 2000 mg of gelatin per square meter of the photosensitive material, and is formed by coating a dispersed solution (in dibutyl phthalate) of 300 mg per square meter of di-tert-octylhydroquinone, and 200 mg per square meter of the mixture of 2-(2'-hydroxy-3',5'-di-tert-butylphenyl)benzotriazole, 2-(2'-hydroxy-5'-tert-butylphenyl)benzotriazole, 2-(2'-hydroxy-3'-tert-butyl-5'-methylphenyl)-5-chlorobenzotriazole, and 2-(2'-hydroxy-3',5'-di-tert-butylphenyl)-5-chlorobenzotriazole as UV absorbers.

Third Layer:

The third layer is a green-sensitive silver-halide emulsion layer composed of a silver chlorobromide emulsion having a silver bromide content of 85 mole %. Said emulsion contains 450 g of gelatin per mole of silver halide; is sensitized by $2.5\times10^{-1}$ moles of a sensitizing dye represented by the following formula per mole of silver halide:

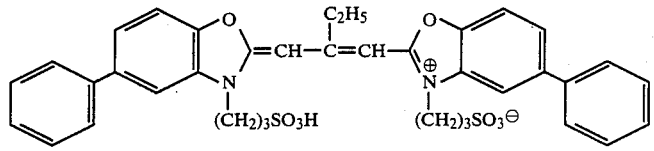

and contains a dispersed solution [in a solvent composed of dibutyl phtalate and tricresyl phosphate (2:1)] of both 2,5-di-tert-butylhydroquinone, and 1-(2,4,6-trichlorophenyl)-3-(2-chloro-5-octadecenylsuccinimidoanilino)-5-pyrazolone (as a magenta coupler; $1\text{-}5\times10^{-1}$ moles of mole of silver halide; and then coated at a rate of 300 mg of silver halide per square meter of the photosensitive layer. In addition, 2,2,4-trimethyl-6-lauryloxy-7-tert-octylcoumarone is added into as an antioxidant at a rate of 0.3 moles per mole of the coupler.

Fourth Layer:

The fourth layer is a gelatin layer which has 2000 mg of gelatin per square meter of photosensitive material; and is formed by coating a dispersed solution (in dibutyl phthlate) of a mixture with both 30 mg per square meter of di-tert-octylhydroquinone, and 200 mg per square meter of a mixture of 2-(2'-hydroxy-3',5'-di-tert-butylphenyl)benzotriazole, 2-(2'-hydroxy-5'-tert-butylphenyl)benzotriazole, 2-(2'-hydroxy-3'-tert-butyl-5'-methylphenyl)-5-chlorobenzotriazole, and 2-(2'-hydroxy-3',5'-tert-butylphenyl)-5-chlorobenzotriazole (2:1.5:1.5:2; as UV absorbers).

Fifth Layer:

The fifth layer is a red-sensitive silver halide emulsion layer composed of a silver chlorobromide emulsion having a silver bromide content of 85 mole %. Said emulsion contains 500 g of gelatin per mole of silver halide; is sensitized by $2.5\times10^{-4}$ moles of a sensitizing dye represented by the following formula:

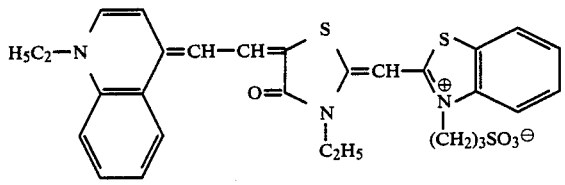

and contains a dispersed solution (in dibutyl phthate) of both 2,5-di-tert-butylhydroquinone, and an equimolar mixture of Exemplified Cyan Coupler (21), and 2,4-dichloro-3-methyl-6-[γ-(2,4-dichloro-3-methyl-6-[γ-(2,4-diamylphenoxy)butylamido]phenol (as cyan couplers; by $3.5\times10^{-1}$ moles per mole of silver halide); and then coated at a rate of 300 mg of silver per square meter.

Sixth Layer:

The sixth layer is a gelatin layer which has 1000 mg of gelatin per square meter.

Each of silver halide emulsions used in the first, third and fifth photosensitive emulsion layers is prepared according to the method described in Japanese Patent Examined Publication No. 7772/1971, chemically sensitized with use of sodium thiosulfate pentahydrate, and added to with 4-hydroxy-6-methyl 1,3,3a,7-tetrazaindene as a stabilizer, bis(vinylsulfonylmethyl)ether as a hardener, and saponin as a coating aid.

The color paper which had been made by the above method was exposed, and continuously processed through the following processes with use of the following processors:

| Standard Processing Conditions: | | |
|---|---|---|
| Color developing: | 38° C. | 3½ minutes |
| Bleach-Fixing: | 33° C. | 1½ minutes |
| Stabilizing: | 25–35° C. | 3 minutes |
| Drying: | 75–100° C. | ca. 2 minutes |
| Composition of Processing Solutions | | |
| (Tank Color Developer) | | |
| Benzyl alcohol | | 15 ml |
| Ethylene glycol | | 15 ml |
| Potassium sulfite | | 2.0 g |
| Patassium bromide | | 1.3 g |
| Sodium chloride | | 0.2 g |
| Potassium carbonate | | 30.0 g |
| 3-Methyl-4-amino-N—ethyl-N—(β-methanesulfonamidoethyl)-aniline sulfate | | 5.5 g |
| OBA (4,4'-diaminostilbenedisulfonic acid derivative; Kaycoll PK-Conc, Shin Nisso Kako Co.) | | 1.0 g |
| Hydroxylamine sulfate | | 3.0 g |
| 1-Hydroxyethylidene-1,1-diphosphonic acid | | 0.4 g |
| Hydroxyethyliminodiacetatic acid | | 5.0 g |
| Magnesium chloride, hexahydrous | | 0.7 g |
| Disodium 1,2-dihydroxybenzene-3,5-disulfonate | | 0.2 g |
| Water to make | | 1 liter |
| KOH or $H_2SO_4$ to make pH | | 10.20 |
| (Color Developer Replenisher) | | |
| Benzyl alcohol | | 20.0 ml |
| Ethylene glycol | | 15.0 ml |
| Potassium sulfite | | 3.0 g |
| Potassium carbonate | | 30.0 g |
| Hydroxylamine sulfate | | 4.0 g |
| 3-Methyl-4-amino-N—ethyl-N—(β-methanesulfonamidoethyl)-aniline sulfate | | 7.5 g |
| OBA (4,4'-diaminostilbenedisulfonic acid derivative; Kaycoll PK-Conc, Shin Nisso Kako Co.) | | 2.5 g |
| 1-Hydroxyethylidene-1,1-diphosphonic acid | | 0.5 g |
| Hydroxyethyliminodiacetic acid | | 5.0 g |
| Magnesium chloride, hexahydrous | | 0.8 g |
| Disodium 1,2-dihydroxybenzene-3,5-disulfonate | | 0.3 g |
| Water to make | | 1 liter |
| KOH to make pH | | 10.70 |
| (Tank Bleach-Fixer) | | |
| Ferric ammonium ethylenediaminetetraacetate, dihydrous | | 60 g |
| Ethylenediaminetetraacetic acid | | 3 g |
| Ammonium thiosulfate, 70% soln. | | 100 ml |
| Ammonium sulfite 40% soln. | | 27.5 ml |
| Water to make | | 1 liter |
| $K_2CO_3$ or $CH_3COOH$ to make pH | | 7.1 |
| (Replenisher Bleach-Fixer A) | | |
| Ferric ammonium ethylenediaminetetraacetate, dihydrous | | 260 g |
| Potassium carbonate | | 42 g |
| Water to make | | 1 liter |
| (pH to be 6.7 ± 0.1) | | |
| (Replenisher Bleach-Fixer B) | | |
| Ammonium thiosulfate, 70% soln. | | 500 ml |
| Ammonium sulfite, 40% soln. | | 250 ml |
| Ethylenediaminetetraacetic acid | | 17 g |
| Glacial acetic acid | | 85 ml |
| Water to make | | 1 liter |
| (pH to be 5.3 + 0.1) | | |
| (Tank and Replenisher Washless Stabilizer) | | |
| 5-Chloro-2-methyl-4-isothiazolin-3-one | | 0.02 g |
| 2-Methyl-4-isothiazolin-3-one | | 0.02 g |
| Ethylene glycol | | 1.0 g |
| 2-Octyl-4-isothiazolin-3-one | | 0.01 g |
| 1-Hydroxyethylidene-1,1-disulfonic acid (60% aqueous soln.) | | 3.0 g |
| $BiCl_3$ (45% aqueous soln.) | | 0.65 g |
| $MgSO_4.7H_2O$ | | 0.2 g |
| Ammonia soln., 25% aqueous | | 2.5 g |
| Trisodium nitrilotriacetate | | 1.5 g |
| Water to make | | 1 liter |
| $H_2SO_4$ to make pH | | 7.0 |

An automatic processor was filled with the above tank color developer, tank bleach-fixer and tank stabilizer. A running test was carried out by that, while the color paper was processed, the above supplementary color developer, supplementary bleach-fixers A and B, and supplementary stabilizer were added every 3 minutes with use of measuring cups. The supplementary color developer was delivered to the color developing tank at a rate of 190 ml per square meter of the color paper. Each of supplementary bleach-fixers A and B was delivered to the bleach-fixing tank at a rate of 50 ml per square meter. The supplementary washless stabilizer was delivered to the final stabilizing bath at a rate of 250 ml per square meter.

The series of stabilizing baths of said automatic processor were composed of the first (front) bath through the third (final) bath along the moving direction of the photosensitive material, and the supplementary stabilizer delivered to the final bath was allowed to overflow into the second (intermediate) bath, and so forth to transfer countercurrently against the motion of the photosensitive material.

Thus the continuous processing was conducted until the total of delivered washless stabilizer amounted to three times the capacity of the stabilizing tank. Thereafter, five one-liter samples were collected from the washless stabilizer of each of the first to third baths, added to with the compounds shown in Table 1, respectively, and then the pH of each sample was adjusted to 7.5 with $H_2SO_4$ or KOH. The photosensitive previously prepared in the aforementioned way, was processed through the aforementioned processes with the aforementioned processors. Each of the washless stabilizer samples was separately in a one-liter beaker, allowed to stand at room temperature to observe its appearance during aging. Observed results are shown in Table 2.

After 2 weeks, the photosensitive material was developed again, and obtained samples, together with samples developed within the day, were aged at 85° C. and 60% RH for 10 days. The density of cyan dye of samples before and after aging was determined with a red light by an optical densitometer (Konishiroku, Model PDA-65) to obtain the fading rate of cyan dye. Results are shown in Table 2.

The yellow stain rate of unexposed areas also was determined with a blue light. Results are shown in Table 2.

When each silver ion concentration was measured respectively in the washless stabilizers in the tanks No. 1 through 3, which had been continuously processed,- the silver ion concentration was 1,380 mg/l in Tank No. 1, 252 mg/l in Tank No. 2 and 42 mg/l in Tank No. 3, respectively.

TABLE 1

| Sample No. | Additives | |
|---|---|---|
| 1 | None | |
| 2 | Exempld. Compd. I-1 | 1 g/l |
| | Exempld. Compd. I-1 | 1 g/l |

TABLE 1-continued

| Sample No. | Additives | |
|---|---|---|
| 3 | 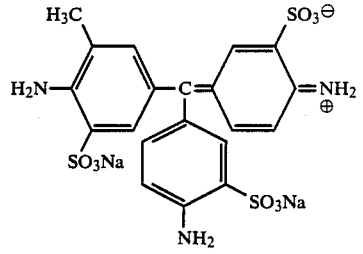 | 5 mg/l |
| 4 | Exempld. Compd. I-1 | 1 g/l |
| | Exempld. Compd. (B-20) | 5 mg/l |
| | Exempld. Compd. I-1 | 1 g/l |
| 5 | Exempld. Compd. (B-20) | 5 mg/l |
| | Ammonium sulfite | 2 g/l |
| | Exempld. Compd. I-1 | 1 g/l |
| 6 | Exempld. Compd. A-1 | 5 mg/l |
| | Ammonium sulfite | 2 g/l |
| | Exempld. Compd. I-1 | 1 g/l |
| 7 | Exempld. Compd. B-8 | 5 mg/l |
| | Ammonium sulfite | 2 g/l |
| | Exempld. Compd. I-1 | 1 g/l |
| 8 | Exempld. Compd. B-10 | 5 mg/l |
| | Ammonium sulfite | 2 g/l |
| | Exempld. Compd. I-1 | 1 g/l |
| 9 | Exempld. Compd. C-3 | 5 mg/l |
| | Ammonium sulfite | 2 mg/l |
| | Exempld. Compd. I-1 | 1 g/l |
| 10 | Exempld. Compd. D-8 | 5 mg/l |
| | Ammonium sulfite | 2 g/l |
| | Exempld. Compd. A-1 | 5 mg/l |
| 11 | Adduct of bisulfite of Exempld. Compd. I-1 (Sodium bisulfite formaldehyde) | 3 g/l |
| | Exempld. Compd. B-20 | 5 mg/l |
| 12 | Adduct of bisulfite of Exempld. Compd. I-1 (Sodium bisulfite formaldehyde) | 3 g/l |
| | Exempld. Compd. A-1 | 5 mg/l |
| 13 | Adduct of bisulfite of Exempld. Compd. I-2 (Sodium bisulfite formaldehyde) | 3 g/l |
| | Exempld. Compd. A-1 | 5 mg/l |
| 14 | Adduct of bisulfite of Exempld. Compd. I-16 | 3 g/l |

TABLE 2

| | Yellow stain (Opt. dens.) | | Cyan dye fading rate, (%) | | Appearance of Washless Stabilizer | | | | | | | | | | | |
|---|---|---|---|---|---|---|---|---|---|---|---|---|---|---|---|---|
| | Immed. | 2 Weeks | Immed. | 2 Weeks | First bath, days | | | | Second bath, days | | | | Third bath, days | | | |
| Sample No. | (a) | (b) | (a) | (b) | 5 | 10 | 15 | 20 | 5 | 10 | 15 | 20 | 5 | 10 | 15 | 20 |
| 1 (Ref.) | 0.22 | 0.22 | 28 | 27 | − | − | − | + | − | − | − | − | − | − | − | − |
| 2 (Ref.) | 0.10 | 0.24 | 49 | 42 | + | ++ | ++ | ++ | − | + | ++ | ++ | − | + | ++ | ++ |
| 3 (Ref.) | 0.12 | 0.25 | 48 | 43 | + | ++ | ++ | ++ | − | + | ++ | ++ | − | + | ++ | ++ |
| 4 (Inv.) | 0.11 | 0.12 | 30 | 29 | − | − | + | ++ | − | − | − | + | − | − | − | + |
| 5 (Inv.) | 0.10 | 0.11 | 26 | 27 | − | − | − | − | − | − | − | − | − | − | − | − |
| 6 (Inv.) | 0.10 | 0.11 | 25 | 26 | − | − | − | − | − | − | − | − | − | − | − | − |
| 7 (Inv.) | 0.11 | 0.12 | 26 | 27 | − | − | − | − | − | − | − | − | − | − | − | − |
| 8 (Inv.) | 0.11 | 0.12 | 25 | 27 | − | − | − | − | − | − | − | − | − | − | − | − |
| 9 (Inv.) | 0.12 | 0.14 | 26 | 28 | − | − | − | + | − | − | − | + | − | − | − | + |
| 10 (Inv.) | 0.10 | 0.12 | 27 | 28 | − | − | − | + | − | − | − | + | − | − | − | + |
| 11 | 0.09 | 0.09 | 24 | 24 | − | − | − | − | − | − | − | − | − | − | − | − |

TABLE 2-continued

| Sample No. | Yellow stain (Opt. dens.) Immed. (a) | Yellow stain (Opt. dens.) 2 Weeks (b) | Cyan dye fading rate, (%) Immed. (a) | Cyan dye fading rate, (%) 2 Weeks (b) | Appearance of Washless Stabilizer: First bath, days 5 | 10 | 15 | 20 | Second bath, days 5 | 10 | 15 | 20 | Third bath, days 5 | 10 | 15 | 20 |
|---|---|---|---|---|---|---|---|---|---|---|---|---|---|---|---|---|
| (Inv.) 12 | 0.10 | 0.10 | 25 | 25 | – | – | – | – | – | – | – | – | – | – | – | – |
| (inv.) 13 | 0.11 | 0.12 | 26 | 27 | – | – | – | – | – | – | – | – | – | – | – | – |
| (Inv.) 14 | 0.09 | 0.10 | 25 | 26 | – | – | – | – | – | – | – | – | – | – | – | – |
| (Inv.) | | | | | | | | | | | | | | | | |

Note:
(a) Developed within the day.
(b) Developed after 2 weekds.
– No precipitate found.
+ Slight precipitate found.
++ Precipitate found.
Ref. Reference.
Inv. According to the Invention.

As seen in comparison with the reference of Sample No. 1 in Table 2, Sample No. 2 in which only the aldehyde compound, Exemplified compound I-1, desirably causes a decreased yellow stain in case of the development immediate after the addition of the aldehyde, but causes an adversely increased yellow stain in case of redevelopment after the aging of the washless stabilizer. In addition, the single use of the aldehyde causes also an increased fading of cyan dye, and proves to cause a seriously deteriorated preservability of the stabilizer from the change in its appearance after aging.

The combined use of a generally known dye other than compounds of the invention also proves ineffective at all from results from Sample No. 3.

Contrarily, Sample Nos. 4 through 14 in which a compound represented by General Formula [II] was used in combination with said aldehyde, keep the yellow stain low even after aging of the washless stabilizer, and very effectively prevent both the fading of cyan dye and the occurrence of precipitate even after aging of the stabilizer; Sample Nos. 5 through 14 in which a sulfide was used in combination with the above compounds used in Sample Nos. 5 through 14 are especially preferable in terms of no occurrence of precipitate at all.

Example 2

Running tests were carried out in a similar way to Example 1 except for using Exemplified Compound (A-1), (B-8), (B-10), (C-3), and (D-8) instead of (B-20). Good results were obtained similarly to those of Example 1.

Example 3

A photosensitive material was prepared in similar was to Example 1 except for adding 300 ml of 2% aqueous solution of Exemplified Compound (A-1) per kg of the emulsion to the red-sensitive emulsion for the fifth layer. In comparison with the photosensitive material prepared in Example 1, running tests were carried out with use of the washless stabilizer, specified below. After the continuous processing, the sample solution was collected from the third bath, and aged in a one-liter beaker. Obtained results are shown in Table 3.

| Washless Stabilizer: | |
|---|---|
| Exemplified Compound I-2 | 1.5 g |
| 1-Hydroxyethylidene-1,1-diphosponic acid | 1.0 g |
| Tri-n-butyl tetradecyl phosphonium salt | 0.03 g |

-continued

| Washless Stabilizer: | |
|---|---|
| Water to make | 1 liter |
| KOH or $H_2SO_4$ to make pH | 7.0 |

TABLE 3

| Photosens. mat., cont. processed. | Appearance of soln. of 3rd. bath, days after 5 | 10 | 15 | 20 | 25 |
|---|---|---|---|---|---|
| Ref. without (A-1) | – | + | ++ | ++ | ++ |
| Inv. with (A-1) | – | – | – | + | ++ |

Notes:
– No precipitate found.
+ Slight precipitate found.
++ Precipitate found.

From Table 3, the compound (A-1) of the invention proves effective also in case of the incorporation into the photographic material.

Furthermore, good results similar to those in Table 3 were obtained also when running tests were carried out with the corporation of Exemplified Compound (B-20) into the photosensitive material.

Effects of the invention are that (1) The occurrence of precipitate in the washless stabilizer is very effectively prevented.
(2) The fading of cyan dye during aging of the dye image obtained by processing the photosensitive material is very effectively prevented, and thereby the amount of washing water required in the process is largely saved.
(3) The promotion of yellow stain of unexposed area of the photosensitive material during a long-term preservation is inhibited.

Example 4

The undermentioned washless stabilizer was taken separately to be added per liter thereof, respectively with 1 ml, 2.5 ml, 5 ml, 20 ml, 100 ml, 250 ml and 500 ml of the bleach-fix solutions containing the silver accumulated in the continuous processes taken in Example 1. The resulted solutions were put into separate beakers each having capacity of 1 liter to allow them to stand at room temperature so as to observe the appearance of each solution after the change on standing. Table 4 shows the results thereof and the silver concentration of each washless stabilizer solution. Two weeks after the abovementioned washless stabilizers were taken and preserved, the same photosensitive materials as in Example 1 were processed with the processing solutions and the processing steps as in the same example, except that the washless stabilizers were used in the aforementioned amounts, respectively. The cyan dye concentration of the developed samples were measured through red-light by making use of an optical densitometyer (Model PDA-65 manufactured by KONISHIROKU PHOTO INDUSTRY CO., LTD., Tokyo, Japan), before and after the samples were preserved for 10 days at 85° C. and 60%RH, so as to obtain their cyan dye fading rate (%). The results thereof are also shown in Table 4.

| (Composition of Washless Stabilizer) | |
|---|---|
| 5-chloro-2-methyl-4-isothiazoline-3-one | 0.01 g |
| 2-methyl-4-isothiazoline-3-one | 0.01 g |
| Ethylene glycol | 1.00 g |
| 2-octyl-4-isothiazoline-3-one | 0.01 g |
| 1-hydroxyethylidene-1,1-diphosphonic acid (60% solution) | 1.50 g |
| $BiCl_3$ (45% solution) | 0.30 g |
| Nitrilotriacetic acid | 1.00 g |
| Aqueous ammonia (25% solution) | 3.00 g |
| Exemplified Compound (I-16) | 2.00 g |
| Add water to make | 1 liter |
| Adjust the pH value with sulfuric acid to | pH 8.0 |

Next, to the abovementioned washless stabilizer was added 10 ml of A-1 and 5 g/l of ammonium sulfite to prepare the washless stabilizer of the invention, and exactly the same tests as mentioned above were tried in the process using the prepared washless stabilizer of the invention.

TABLE 4

| | Bleach-fixer added (ml/l) | Silver concentration (ml/l) | Appearance of washless stabilizer 5 days | 10 days | 15 days | 20 days | Cyan dye fading rate (%) |
|---|---|---|---|---|---|---|---|
| Comparative | 0 | 0 | – | – | – | – | 27 |
| | 1 | 8.1 | – | – | – | – | 30 |
| | 2.5 | 20.2 | – | + | ++ | ++ | 41 |
| | 5 | 40.5 | – | + | ++ | ++ | 44 |
| | 20 | 162 | – | + | ++ | ++ | 44 |
| | 100 | 810 | + | ++ | ++ | ++ | 48 |
| | 250 | 2020 | + | ++ | ++ | ++ | 55 |
| | 500 | 4050 | + | – | + | ++ | 65 |
| Invention | 0 | 0 | – | – | – | – | 27 |
| | 1 | 8.1 | – | – | – | – | 27 |
| | 2.5 | 20.2 | – | – | – | – | 27 |
| | 5 | 40.5 | – | – | – | – | 27 |
| | 20 | 162 | – | – | – | – | 29 |
| | 100 | 810 | – | – | – | – | 32 |
| | 250 | 2020 | – | – | – | + | 35 |
| | 500 | 4050 | – | – | – | + | 50 |

As is obvious from the table, it can be understood that the invention is effective when the silver concentration of a washless stabilizer is not less than 20 mg per liter.

What is claimed is:

1. A processing method for silver halide color photosensitive material in which said silver halide color photosensitive material is treated with a processing solution that has a fixing ability, and then is not washed, but treated with a washless stabilizer solution, characterized in that said silver halide color photosensitive material is treated with said washless stabilizer in the presence of at least one compound among compounds represented by General Formula [1], [II], [II'], or [II''] shown below; and that said washless stabilizer contains more than 20 mg/l silver ion, and at least one aldehyde compound:

General Formula [I]

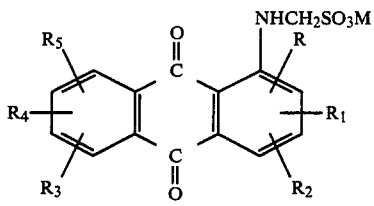

where each of R, $R_1$, $R_2$, $R_3$, $R_4$, and $R_5$ is a hydrogen or halogen atom, or a hydroxy, alkyl, alkoxy, sulfo or $—NHCH_2SO_3M$ group; M is a cation;

General Formula [II]

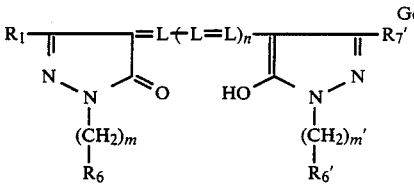

where each of $R_6$ and $R_6'$ is a hydrogen atom, or an alkyl, aryl or heterocyclic group; each of $R_7$ and $R_7'$ is a hydroxyl, alkoxy, substituted alkoxy, cyano, trifluoromethyl, $—COOR_8$, $—CONHR_8$, $—NHCOR_8$, amino, or $C_{1-4}$-alkyl-substituted amino group, or a cyclic amino group represented by a formula

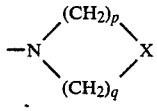

(where each of p and q is the integer 1 or 2; X is an oxygen or sulfur atom, or a $—CH_2—$ group); $R_8$ is a hydrogen atom, or an alkyl or aryl group; L is a methin group; n is the integer 0, 1 or 2; each of m and m' is the integer 0 or 1;

General Formula [II']

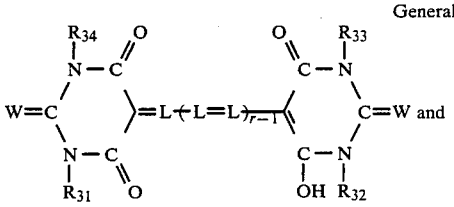

where r is 1, 2 or 3; W is an oxygen or sulfur atom; L is a methine group; each of $R_{31}$ to $R_{34}$ is a hydrogen atom, or an alkyl, aryl, or aralkyl, or heterocyclic group; and at least one group of $R_{31}$ to $R_{34}$ is a substituent group other than a hydrogen atom;

General Formula [II'']

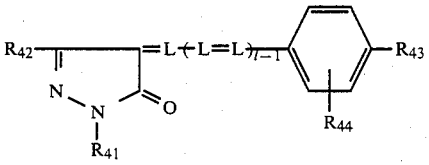

where l is the integer 1 or 2; L is a methine group; $R_{41}$ is an alkyl, aryl, or heterocyclic group; $R_{42}$ is a hydroxy, alkyl, alkoxy substituted alkoxy, cyano, trifluoromethyl, —$COOR_8$, —$CONHR_8$, —$NHCOR_8$, amino, or $C_{1-4}$-alkyl-substituted amino group, or a cyclic amino group represented by a formula

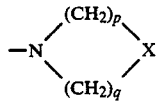

(where each of p and q is an oxygen or sulfur atom, or a —$CH_2$— group); $R_8$ is a hydrogen atom, or an alkyl or aryl group; further, $R_{43}$ is allowed to be an —OZ, or

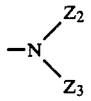

group where each of $Z_1$, $Z_2$ and $Z_3$ is a hydrogen atom, or an alkyl group; and $Z_2$ and $Z_3$ are allowed to be the same or to form a ring with the combination with each other; and $R_{44}$ is a hydrogen or chlorine atom, or an alkyl or alkoxy group.

2. A processing method as claimed in claim 1, wherein said washless stabilizer contains at least $1\times10^{-3}$ mole/l of sulfite.

3. A processing method as claimed in claim 1, wherein said processing solution that has a fixing ability contains thiosulfate.

4. A processing method as claimed in claim 2, wherein said washless stabilizer contains said sulfite as an adduct of an aldehyde.

5. A processing method as claimed in claim 1, wherein said compound represented by one formula selected from the formulas [I], [II], [II'] and [II''] is present in an amount of from 1 to 800 mg per sq.meter of a photosensitive material, in said photosensitive material.

6. A processing method as claimed in claim 5, wherein said compound represented by one formula selected from the formulas [I], [II], [II'] and [II''] is present in an amount of from 2 to 200 mg per sq.meter of a photosensitive material, in said photosensitive material.

7. A processing method as claimed in claim 1, wherein said compound represented by one formula selected from the formulas [I], [II], [II'] and [II''] is present in an amount of from 0.005 mg to 200 mg per liter of said washless stabilizer, in said washless stabilizer.

8. A processing method as claimed in claim 7, wherein said compound represented by one formula selected from the formulas [I], [II], [II'] and [II''] is present in an amount of from 0.01 mg to 50 mg per liter of said washless stabilizer, in said washless stabilizer.

9. A processing method as claimed in claim 1, wherein said washless stabilizer is replenished in an amount of not more than 2 liters per sq.meter of a photosensitive material.

10. A processing method as claimed in claim 9, wherein said washless stabilizer is replenished in an amount of not more than 1 liter per sq.meter of a photosensitive material.

11. A processing method as claimed in claim 10, wherein said washless stabilizer is replenished in an amount of not more than 500 ml per sq.meter of a photosensitive material.

12. A processing method as claimed in claim 2, wherein said washless stabilizer contains a sulfite in an amount of from $5\times10^{-3}$ mol/l to $10^{-1}$ mol/l.

13. A processing method as claimed in claim 1, wherein the pH value of said washless stabilizer is from 3.0 to 9.5.

14. A processing method as claimed in claim 13, wherein the pH value of said washless stabilizer is from 3.5 to 9.0.

15. A processing method as claimed in claim 1, wherein said washless stabilizer contains an ammonium compound.

16. A processing method as claimed in claim 15, wherein said ammonium compound is in an amount of from 0.001 mole to 1.0 mole per liter of said washless stabilizer.

17. A processing method as claimed in claim 16, wherein said ammonium compound is in an amount of from 0.002 mole to 0.2 mole per liter of said washless stabilizer.

18. A processing method as claimed in claim 3, wherein said washless stabilizer is replenished in an amount of not more than 1 liter per sq. meter of a photosensitive material, said washless stabilizer contains a sulfite in an amount of from $5\times10^{-3}$ mol/l to $10^{-1}$ mol/l, the pH value of said washless stabilizer is from 3.5 to 9.0, said ammonium compound is in an amount of from 0.001 mole to 1.0 mole per liter of said washless stabilizer, and said compound represented by one formula selected from the formulas [I], [II], [II'] and [II''] is present in an amount of from 2 to 200 mg per sq. meter of a photosensitive material, in said photosensitive material.

19. A processing method as claimed in claim 3, wherein said washless stabilizer is replenished in an amount of not more than 1 liter per sq. meter of a photosensitive material, said washless stabilizer contains a sulfite in an amount of from $5\times10^{-3}$ mol/l to $10^{-1}$ mol/l, the pH value of said washless stabilizer is from 3.5 to 9.0, said ammonium compound is in an amount of from 0.001 mole to 1.0 mole per liter of said washless stabilizer, and said compound represented by one formula selected from the formulas [I], [II], [II'] and [II''] is present in an amount of from 0.01 mg to 50 mg per liter of said washless stabilizer, in said washless stabilizer.

20. A processing method as claimed in claim 18, wherein said washless stabilizer contains said sulfite as an adduct of an aldehyde, said washless stabilizer is replenished in an amount of not more than 500 ml per sq. meter of a photosensitive material, said ammonium compound is in an amount of from 0.002 mole to 0.2 mole per liter of said washless stabilizer, and said compound represented by one formula selected from the formulas [I], [II], [II'] and [II''] is present in an amount of from 0.005 mg to 200 mg per liter of said washless stabilizer, in said washless stabilizer.

21. A processing method as claimed in claim 19, wherein said washless stabilizer contains said sulfite as an adduct of an aldehyde, said washless stabilizer is replenished in an amount of not more than 500 ml per sq. meter of a photosensitive material, and said ammonium compound is in an amount of from 0.002 mole to 0.2 mole per liter of said washless stabilizer.

22. A processing method as claimed in claim 20, wherein said washless stabilizer contains silver in an amount from 40 mg/l to 4 g/l of said washless stabilizer.

23. A processing method as claimed in claim 21, wherein said washless stabilizer contains silver in an amount from 40 mg/l to 4 g/l of said washless stabilizer.

24. A processing method as claimed in claim 22, wherein said aldehyde is in an amount from 0.5 g/l to 10 g/l of said washless stabilizer.

25. A processing method as claimed in claim 23, wherein said aldehyde is in an amount of from 0.5 g/l to 10 g/l of said washless stabilizer.

26. A processing method as claimed in claim 1, wherein said aldehyde is in an amount from 0.1 g/l to 50 g/l of said washless stabilizer.

* * * * *